US006131901A

United States Patent [19]

Hirohata

[11] Patent Number: 6,131,901

[45] Date of Patent: Oct. 17, 2000

[54] SHEET-STACKING DEVICE, SUCTION CONVEYOR, AND SUCTION BELT FOR SHEET STACKERS

[75] Inventor: Atsuhisa Hirohata, Kasugai, Japan

[73] Assignee: Kabushiki Kaisha Isowa, Japan

[21] Appl. No.: 09/262,580

[22] Filed: Mar. 4, 1999

[30] Foreign Application Priority Data

Mar. 9, 1998 [JP] Japan ..... 10-076714

[51] Int. Cl.[7] ..... B65H 29/70; B65H 29/32; B65H 5/02; B65H 29/54

[52] U.S. Cl. ..... 271/276; 271/188; 271/197; 271/308

[58] Field of Search ..... 271/188, 197, 271/216, 237, 276, 308

[56] References Cited

U.S. PATENT DOCUMENTS

| | | | |
|---|---|---|---|
| 3,452,982 | 7/1969 | Bischoff | 271/197 |
| 3,796,424 | 3/1974 | Fox | 271/197 |
| 4,027,873 | 6/1977 | Bishop | 271/197 |
| 4,295,737 | 10/1981 | Silverberg | 271/197 |
| 4,436,302 | 3/1984 | Frye et al. | 271/216 |
| 4,905,843 | 3/1990 | Holbert | 209/571 X |
| 5,014,978 | 5/1991 | Smith et al. | 271/308 |
| 5,074,547 | 12/1991 | Smith et al. | 271/308 |
| 5,161,796 | 11/1992 | Okamoto | 271/308 |
| 5,203,556 | 4/1993 | Smith et al. | 271/308 |
| 5,562,281 | 10/1996 | Honda et al. | 271/308 |
| 5,671,920 | 9/1997 | Aquaviva et al. | 271/197 |

*Primary Examiner*—Christopher P. Ellis
*Assistant Examiner*—Kenneth W Bower
*Attorney, Agent, or Firm*—Morrison Law Firm

[57] ABSTRACT

A suction conveyor conveys sheets which are stacked in a hopper of a sheet stacker. The suction conveyor includes a suction box and a suction belt that cycles along the surface of the suction box. Porous sections, having sets of suction holes or the like, are formed intermittently at a prescribed pitch on the suction belt. The leading section of the sheet is suctioned to these porous sections, and the sheets are conveyed by the motion of the belt. A scraper at a terminal end region of the conveyance path forcibly peels off the sheet from the porous sections of the suction belt. The sheets are dropped down with the trailing end dropping before the leading end and are stacked in the hopper.

24 Claims, 20 Drawing Sheets

25
18
17
30
31
24
12
23
29
34
35

2

SEC.A-A

SHEET-STACKING DEVICE, SUCTION CONVEYOR, AND SUCTION BELT FOR SHEET STACKERS

BACKGROUND OF THE INVENTION

The present invention relates to a sheet-stacking device including a suction conveyor, and a suction belt for sheet stackers. More specifically, the present invention relates to a technology suited for stacking sheets of cardboard.

Referring to FIG. 30, a conventional sheet conveyer includes a sandwich belt conveyor 100 which conveys a sheet S between an upper and lower belt. Sheet S moves in the direction of the arrows until it is released into a sheet stacking hopper 103.

Referring to FIG. 31 and FIG. 32, conventional suction belt conveyors 101 and 102 use a negative pressure to hold either the top or the bottom surface of sheet S tightly against it.

Although suction belt conveyors 101 and 102 reliably convey the sheets S along their length, when sheet S is discharged into hopper 103, the trailing end of an earlier sheet can rise up (see FIG. 33) and interfere with later sheets. This results in a jam in hopper 103. Furthermore, sandwich belt conveyor 100 exerts a weak grip on the sheets. This weak grip may result in misalignment of the sheets during conveyance, making synchronization of the upper and lower belts difficult.

Referring to FIG. 34, an appropriate number of striking members 105 forcibly strike down the sheets below a suction belt 106. The force of striking members 105 onto the sheets can result in damage to the sheets. However, if the negative pressure suction is too strong, the sheets may not disengage from suction belt 106. Finally, when the sheets are dislodged, the sheets can tend to drop down in a forward tilting orientation, making it possible for the sheets to slide under previous sheets.

OBJECTS AND SUMMARY OF THE INVENTION

It is an object of the present invention to provide a sheet stacking device which overcomes the foregoing problems.

It is a further object of the present invention to provide a sheet stacking device which reduces jams caused by the rising up of the trailing end of the sheets.

It is yet a further object of the present invention to provide a suction conveyor which allows the sheets to be reliably conveyed.

It is still a further object of the present invention to provide a sheet stacking device which allows the sheets to be reliably disengaged from a suction belt.

Briefly stated, the present invention provides a suction conveyor conveying sheets which are stacked in a hopper of a sheet stacker. The suction conveyor includes a suction box and a suction belt that cycles along the surface of the suction box. Porous sections, having sets of suction holes or the like, are formed intermittently at a prescribed pitch on the suction belt. The leading section of the sheet is suctioned to these porous sections, and the sheets are conveyed by the motion of the belt. A scraper at a terminal end region of the conveyance path forcibly peels off the sheet from the porous sections of the suction belt. The sheets are dropped down with the trailing end dropping before the leading end and are stacked in the hopper.

According to an embodiment of the invention, there is provided a sheet stacking device for conveying and stacking at least first and second sheets comprising a suction box, a suction belt, at least a portion of the suction belt passing in contact with the suction box, at least a portion of the suction belt having porous sections whereby a suction in the suction box is communicated for suction holding of the first sheet moving thereon, means for separating the first sheet from the suction belt, the second sheet being conveyed spaced from and following the first sheet on the suction belt, the means for separating being further effective for separating the second sheet from the suction belt, and at least one of the suction belt and the means for separating including orienting means for discharging the first sheet with its trailing end lower than a leading end of the first sheet, whereby the leading end of the second sheet passes over the trailing end of the first sheet and jamming of the first and second sheets is avoided.

According to another embodiment of the invention, there is provided a sheet stacking device for conveying and stacking at least first and second sheets comprising a suction box, a suction belt, the suction belt having a plurality of porous sections separated by nonporous sections, whereby a suction in the suction box is communicated for suction holding of the first and second sheets moving thereon, a pitch of porous sections exceeding a length of the first and second sheets, means for separating the first sheet from the suction belt, the second sheet being conveyed spaced from and following the first sheet on the suction belt, the suction being applied only to a leading end of the first and second sheets, thereby conveying each sheet with a trailing end of each sheet lower than the leading end, the means for separating being further effective for separating the second sheet from the suction belt, and the separating means discharging the first sheet with its trailing end lower than a leading end of the first sheet, whereby the leading end of the second sheet passes over the trailing end of the first sheet and jamming of the first and second sheets is avoided.

According to a further embodiment of the invention, there is provided a sheet stacking device for conveying and stacking at least first and second sheets comprising a suction box, a suction belt, at least a portion of the suction belt passing in contact with the suction box, the suction belt having a plurality of porous sections separated by nonporous sections, whereby a suction in the suction box is communicated for suction holding of the first and second sheets moving thereon, a pitch of porous sections exceeding a length of the first and second sheets, means for separating the first sheet from the suction belt, the second sheet being conveyed spaced from and following the first sheet on the suction belt, the suction being applied only to a central portion of the first and second sheets, and the means for separating being further effective for separating the second sheet from the suction belt; and the separating means discharging the first sheet with its trailing end lower than a leading end of the first sheet, whereby the leading end of the second sheet passes over the trailing end of the first sheet and jamming of the first and second sheets is avoided.

According to another embodiment of the invention, there is provided a sheet conveying and stacking apparatus for conveying and stacking first and second sheets, the first and second sheets passing sequentially along the apparatus, comprising a suction conveyor for conveying the first and second sheets below it, means for separating the first and second sheets from the suction conveyor above a stacking location, and means for forcing a trailing end of the first sheet to a position lower than a leading end of the second sheet when the second sheet is separated from the suction conveyor.

According to a further embodiment of the invention, there is provided a method for conveying and stacking first and second sheets with a suction conveyor, comprising conveying the first and second sheets sequentially along the suction conveyor, releasing the first and second sheets over a stacking location, and forcing a trailing end of the first sheet to a position lower than a leading end of the second sheet when the second sheet is separated from the suction conveyor.

The porous sections formed at sections of the suction belt can be formed as an appropriate number of holes having a prescribed size. Alternatively, instead of clearly defined holes, a porous material is used in the porous sections of the suction belt. In the separating device, a scraper performs a peeling action that frees the leading section of the sheet from the porous sections of the suction belt. Alternatively, it is also possible to have the separating device come into contact with the leading end of the sheet so that the leading section of the sheet is shifted away from the porous sections of the suction belt.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
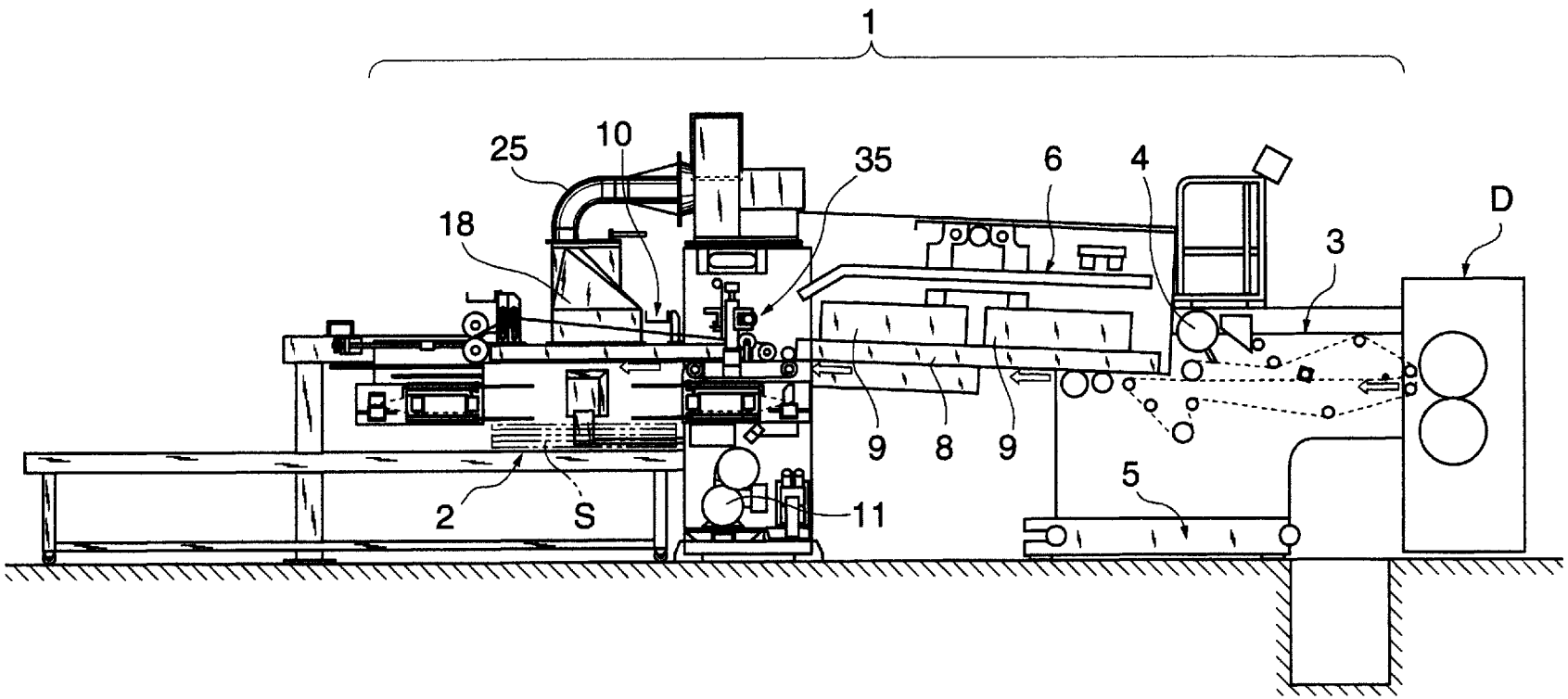
FIG. 1 is a side-view drawing of the entire sheet stacker of a first embodiment of the present invention.

Referring to FIG. 1, a sheet stacker 1 includes a suction conveyor 10 and a hopper 2. The sheet stacker 1 is positioned downstream from a die cutter D. Upstream from die cutter D, printing and the like is performed on sheets of cardboard (not shown in the figure). The sheets are cut at die cutter D into shapes, for example, for making cardboard boxes. The cut sheets are conveyed along the sheet path indicated by arrows. A vibration conveyor 3, disposed immediately downstream from die cutter D, vibrates to shake off loose trim attached to the sheet product. A blower 4 blows away the trim. The separated trim is discarded from sheet stacker 1 through a belt conveyor 5. The resulting sheet products, free from loose trim, are sent through separator conveyor 6 to a suction conveyor 10. The sheets are stacked in hopper 2 (batch stacking).

Figure 7:
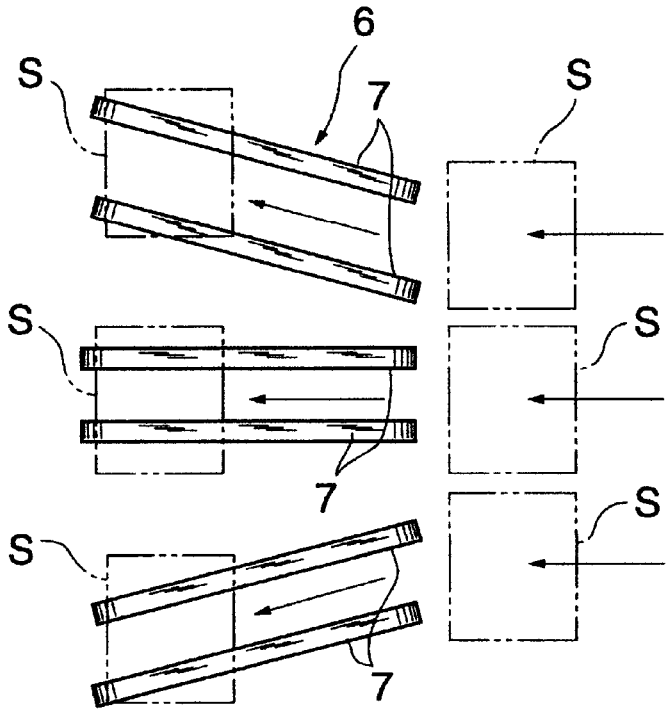
FIG. 7 is a schematic plan drawing of a separating conveyor positioned in the conveyance path upstream from the hopper.

Referring FIGS. 1 and 7, when multiple-piece sheets (for example, three-piece sheets as shown in FIG. 7) are conveyed side by side for loading into hopper 2, separator conveyor 6 increases the spaces between sheets S. In this configuration, the resulting space between adjacent sheets S is adjusted to a prescribed value. Separator conveyor 6 uses a standard suction belt 7. A suction box 8 and a duct 9 provide the negative-pressure suction used for separator conveyor 6. A main motor 11, driving all the conveyor lines, is located below a region near a terminal end of separator conveyor 6.

Figure 2:
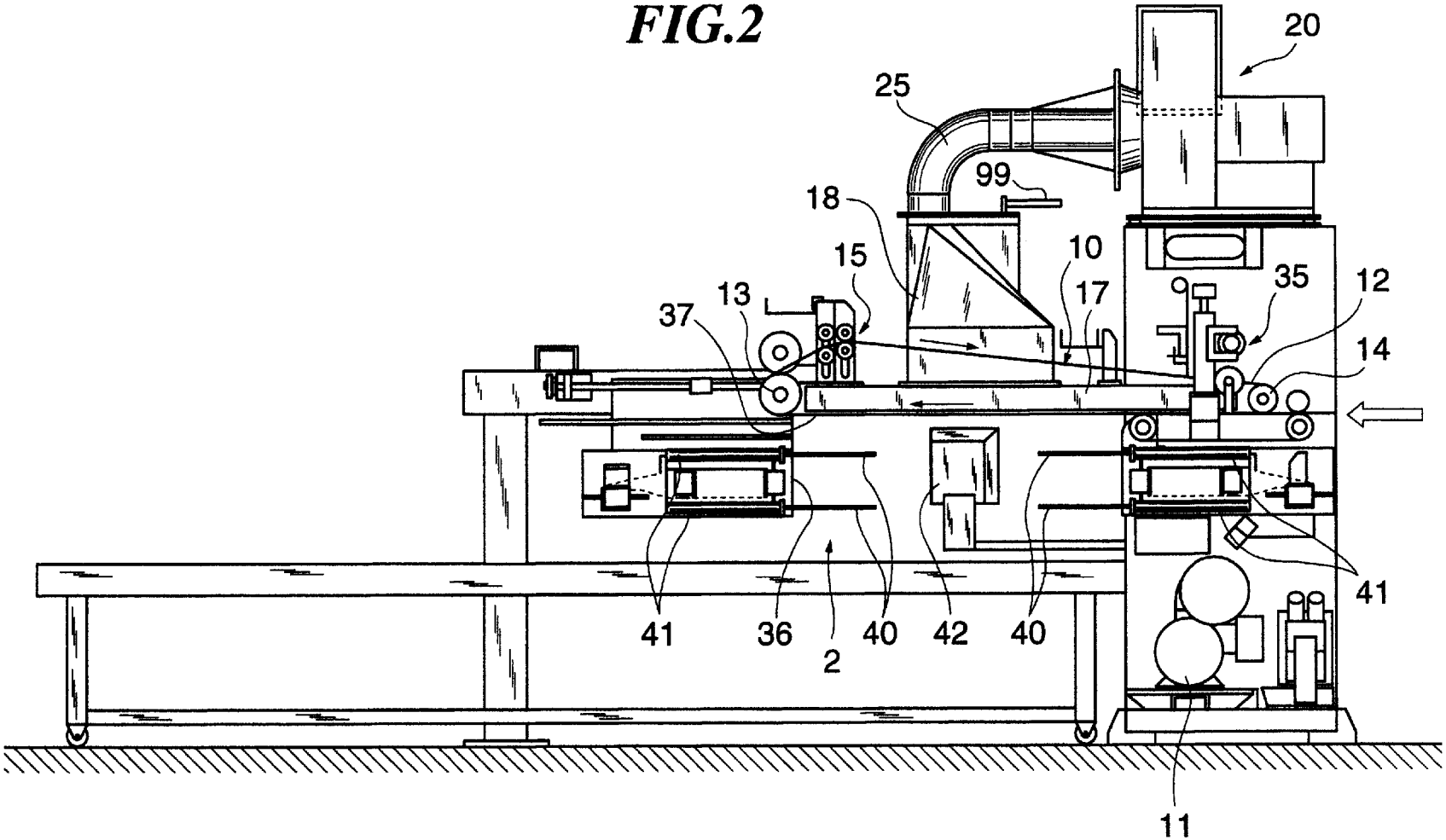
FIG. 2 is an enlarged side-view drawing showing the main elements of the sheet stacker of FIG. 1.

Referring to FIG. 2, suction conveyor 10, used with hopper 2, includes a suction belt 12 extending over pulleys 13 and 14. A tension application device 15 keeps an appropriate tension on suction belt 12. The rotation of suction belt 12 is indicated by single-line arrows. The lower surface of suction belt 12 forms a flat conveyance path on which a sheet is attached by a suction force. A suction box 17 extends horizontally along the conveyance path. The suction force is provided through a duct 18 to suction box 17 from an air suction device 20. A blower, negative-pressure pump, or any other suction means is used for air suction device 20. A damper 99 is used as a negative pressure adjusting device. Damper 99 adjusts the negative pressure applied to the sheets according to factors related to the sheets, such as the width of the sheets, the thickness of the sheets, and the rigidity of the sheets. Damper 99 turns the negative pressure from each individual suction box 17 on or off. Damper 99 can be manually operated or optionally driven by an actuator (not shown), such as an air cylinder or a motor. The negative pressure applied to the sheets can also be adjusted by adjusting the speed of the motor or the like that serves as the drive source for air suction device (negative-pressure generating device) 20.

Figure 4A:
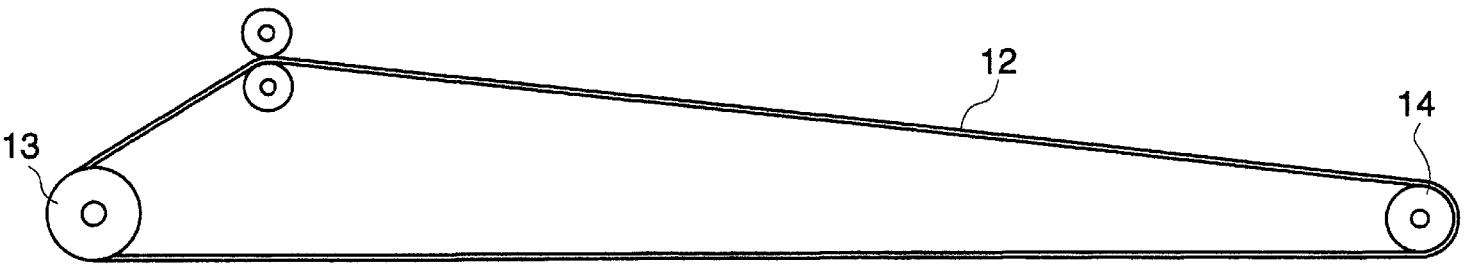
FIG. 4*a* shows the path of a suction belt in a sheet stacker according to the present invention.
Figure 4B:
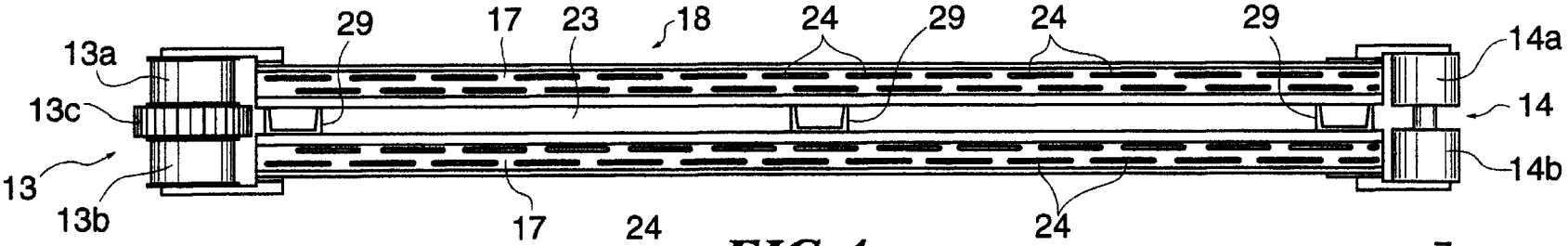
FIGS. 4*b* and 4*c* are drawings primarily showing a bottom view of a suction conveyor and a suction box thereof according to the present invention.
Figure 4C:
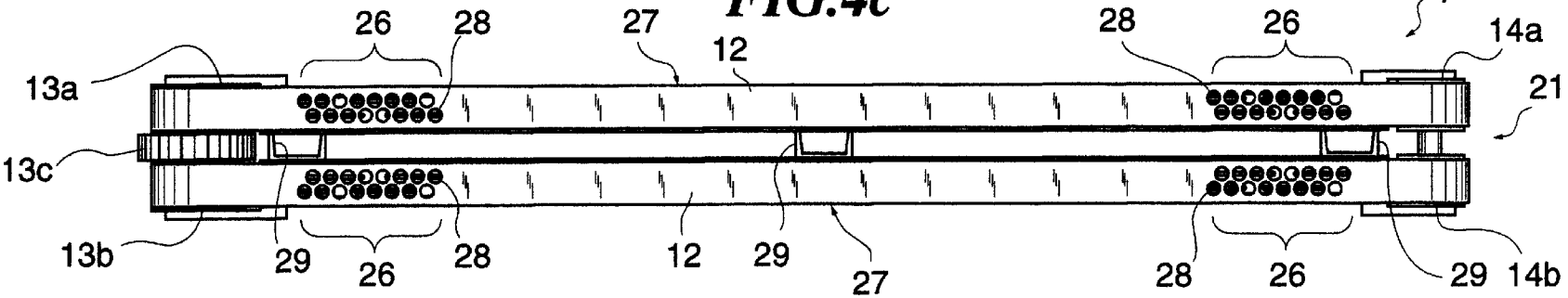

Referring to FIG. 4*a*, the circulation path of suction belt 12 is shown. Referring to FIG. 4*b*, suction box 17, as seen from below, is shown. Referring to FIG. 4*c*, suction box 17 (not shown), with suction belt 12 attached, is shown as seen from below. In the example of FIGS. 4*b* and 4*c*, two suction belts 12 form a single suction unit 21. Accordingly, two independent suction boxes 17 extend along suction belts 12. A space 23, which is open to atmospheric pressure, results between suction boxes 17. Multiple slits 24 are formed on suction boxes 17 along the longitudinal axes of suction belts 12. The negative pressure in suction boxes 17 acts on suction belts 12 through slits 24. A connecting frame 29 connects adjacent suction boxes 17.

Figures 5A, 5B, 5C:
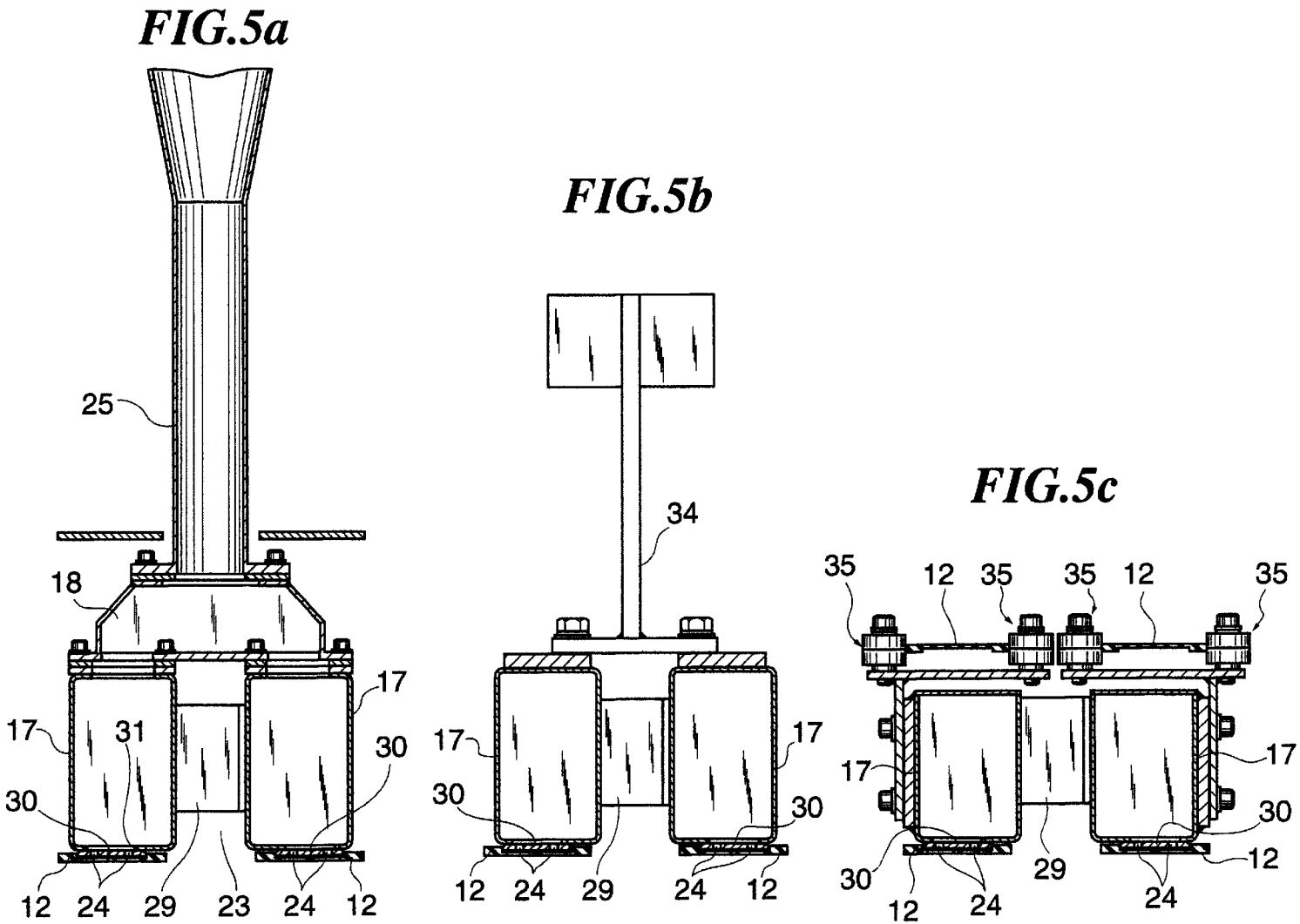
FIGS. 5*a*, 5*b*, and 5*c* show different longitudinal cross-section drawings of the suction conveyor.

Referring to FIG. 5*a*, the pair of suction boxes 17 share suction from duct 18. A suction pipe 25 connects to air suction device 20.

Returning now to FIGS. 4*b* and 4*c*, pulley 13, serving as the drive pulley for suction belt 12, includes a coaxial pulley 13*a* and an integral pulley 13*b*. Interposed between coaxial pulley 13*a* and integral pulley 13*b* is an integral and coaxial drive gear 13*c*. A gear, or timing belt, (not shown) for transferring a drive force, is connected to gear 13*c* (or timing pulley). An idler pulley 14, located opposite pulley 13, includes a coaxial pulley 14*a* and an integral pulley 14*b*. Suction belt 12 rotates freely about coaxial pulley 14*a* and integral pulley 14*b*. One of suction belts 12 extends over pulleys 13*a* and 14*a*, while the other suction belt 12 extends over the pulleys 13*b* and 14*b*. Drive gear 13*c*, interposed between pulleys 13*a* and 13*b*, provides for the synchronous rotation of suction belts 12.

Suction hole sets 26, formed at a prescribed pitch along the longitudinal axis of suction belts 12, serve as porous sections. In other words, suction hole sets 26 are formed intermittently at equal intervals along the longitudinal axis of suction belts 12. Suction hole sets 26 are formed at substantially equivalent positions on adjacent suction belts 12. Non-ventilated sections 27 result from the belt sections of suction belts 12 where suction hole sets 26 are absent. In this embodiment, a rubber belt is used for suction belts 12, and non-ventilated sections 27 are formed with a solid piece of rubber. Suction hole sets 26 are formed as two rows of suction holes 28 disposed along the longitudinal axis of suction belts 12 (in the embodiment of FIG. 4, there are 8 holes for each row). The rows of suction holes 28 are disposed in a staggered arrangement so that the center of one hole is at the midpoint between hole centers from the adjacent row. This arrangement of suction holes 28 allows an appropriate number of suction holes 28 to be formed within the limited width of suction belts 12 without having the material between suction holes 28 from adjacent rows be too thin. A top side of a sheet spans at least two adjacent suction hole sets 26.

In an alternate embodiment of the present invention, the porous sections, instead of containing suction hole sets 26, are formed of a porous material in the regions of suction belt 12 where suction is desired.

Referring to FIGS. 5*a*, 5*b*, and 5*c*, belt guides 30, shaped in a band, are fixed to the lower surfaces of suction boxes 17. Belt guides 30 guide suction belts 12 along their path (cycling motion). Slits 24 are formed on belt guides 30 to apply a negative pressure to suction belt 12. Openings 31, located on the bottom surfaces of suction boxes 17, provide an air path through slits 24 into suction boxes 17. Openings 31, extending along the longitudinal axes of belt guides 30, are slightly narrower than belt guides 30. The negative pressure from suction boxes 17 acts on suction belts 12 through openings 31, belt guides 30, and slits 24.

A central portion along the longitudinal axis of suction box 17 has part of its load supported by a main frame (not shown in the figure) using a suspension member 34 (vertical frame). Belt guide sections 35, also shown in FIG. 1 and FIG. 2, are positioned at the entry end of suction conveyor 10. Belt guide section 35 includes a guide roller that freely rotates in response to contact with the edges of suction belts 12, preventing lateral meandering of suction belts 12.

Figure 6:
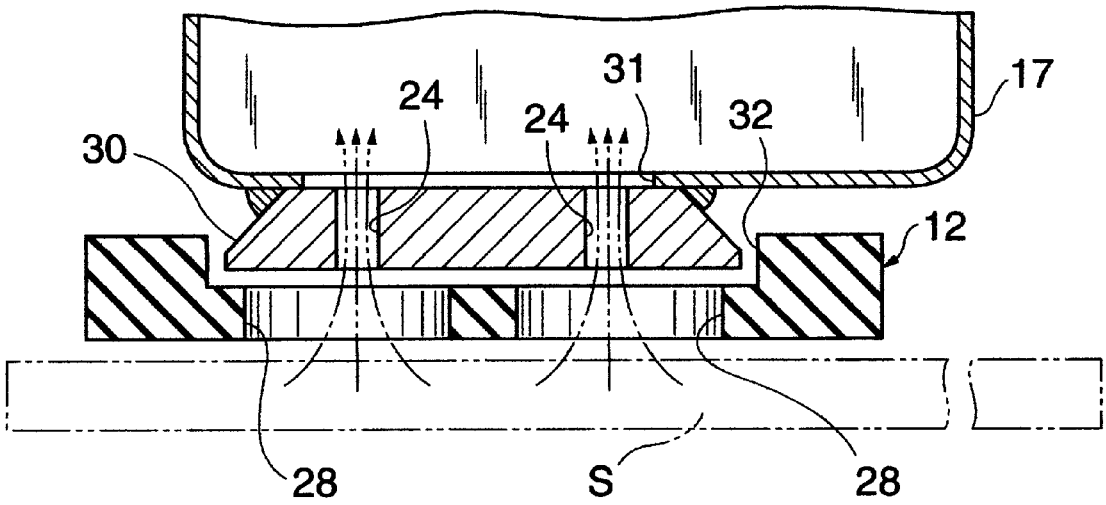
FIG. 6 is a schematic cross-section drawing of a suction box of the suction conveyor of FIGS. 5*a*, 5*b*, and 5*c*.

Referring to FIG. 6, belt guide 30 is a long, band-shaped plate having beveled comers on the upper side. Guide grooves 32, located on suction belt 12, fit against roughly half the thickness of belt guide 30. With guide groove 32 fitted to belt guide 30, suction belt 12 moves (slides) along its longitudinal axis in a linear path without meandering laterally. The dotted arrows in FIG. 6 indicate the negative pressure (suction power) coming from suction box 17, going through suction belt 12, and being applied to sheet S.

Figure 8:
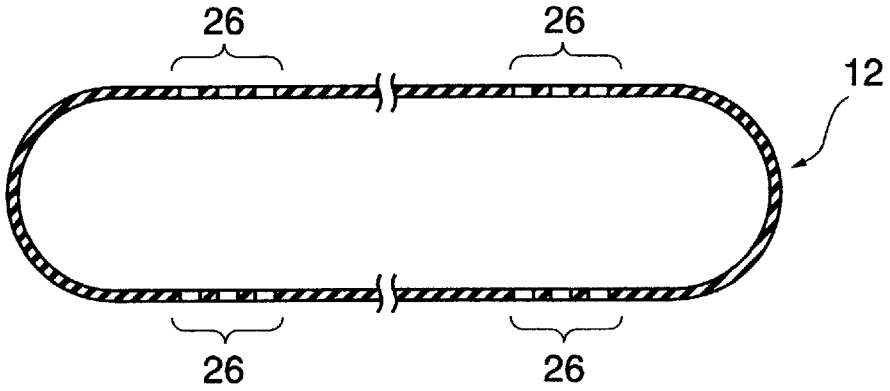
FIG. 8 is a schematic drawing of an example of a suction belt according to the present invention.
Figure 9:
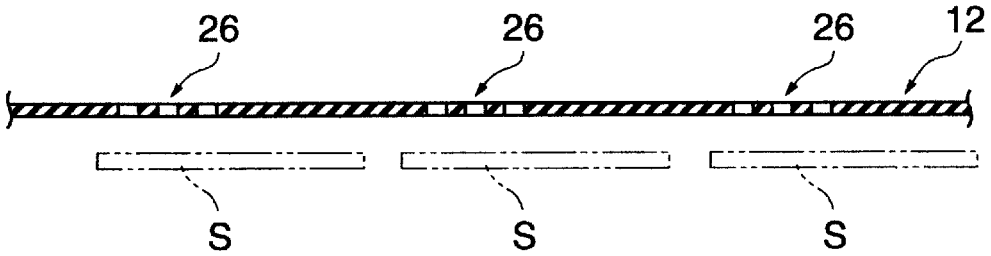
FIG. 9 is a schematic drawing of a portion of the suction belt shown in FIG. 8.

Referring to FIGS. 8 and 9, conceptual representations of the suction between suction belt 12 and sheet S are shown. In FIG. 8, suction hole sets 26 are spaced at equal intervals along the longitudinal axis of suction belt 12. In FIG. 9, the intervals between suction hole sets 26 correspond to the individual conveying of sheets S. One of suction hole sets 26 will suction the leading end of one sheet S, and the next suction hole set 26 will suction the leading end of the next sheet S. Thus, the pitch at which the suction hole sets 26 are arranged must be the same as the theoretical length of the circumference of the printing cylinder of the printer (not shown).

Figure 10:
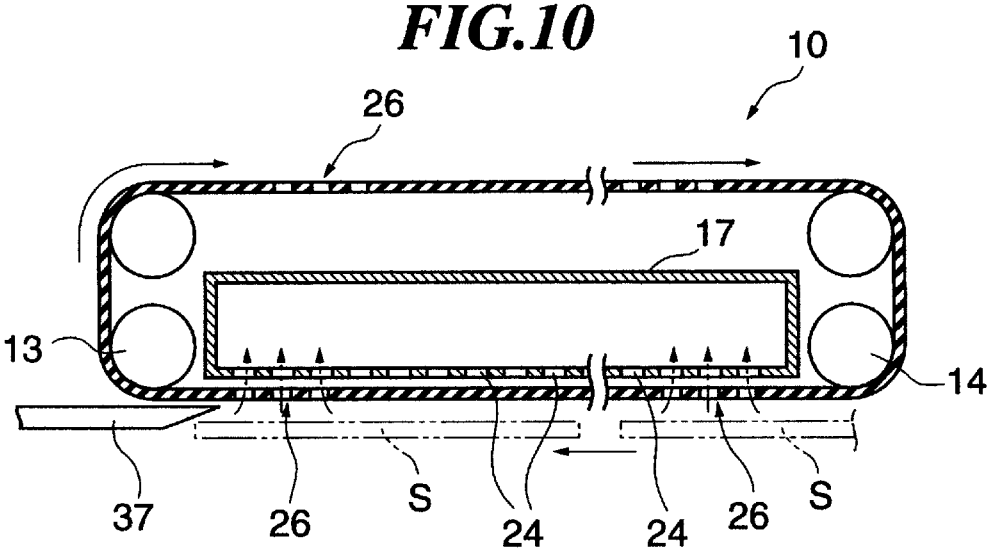
FIG. 10 is a schematic drawing to which reference will be made in describing a suction conveyor that includes the suction belt from FIG. 8.

Referring to FIG. 10, as suction belt 12, having intermittently formed suction hole sections 26 at a prescribed pitch, passes the lower surface of suction box 17, negative- pressure suction acts only on suction hole sets 26 of suction belt 12 that face suction box 17. Only the leading end of sheet S facing suction hole sets 26 is suctioned to suction belt 12 and conveyed. The cycling phase of suction belt 12 and the timing for sheets S are coordinated so that the subsequent sheets S are suctioned by the subsequent suction hole sets 26 of suction belt 12.

Figure 11:
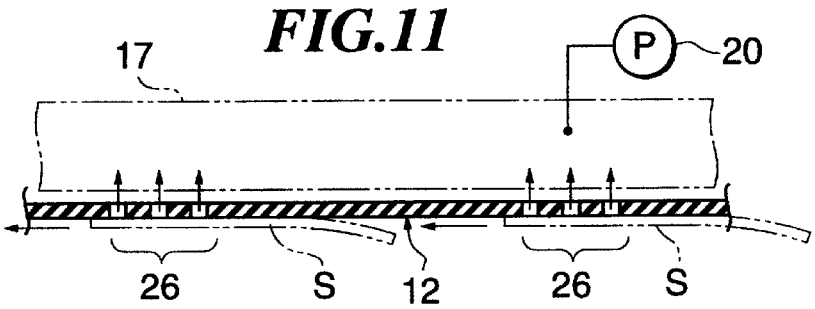
FIG. 11 is a figure showing the leading section of the sheet suctioned to a suction belt.

Referring to FIG. 11, an example is shown where only the leading end of sheet S is suctioned and conveyed by suction hole sets 26 of suction belt 12.

Referring back to FIG. 2, the sheet (not shown), having only its leading end suctioned, reaches hopper 2. Hopper 2 includes a stopper 36 (sheet aligning member) that aligns the leading end of incoming sheets. Stopper 36 is located at a prescribed position along the conveyance path of suction conveyor 17. A scraper 37 serves as a separating device for separating the sheet from suction belt 12. Scraper 37 is located in the region above stopper 36, upstream from suction belt 12.

Figure 17:
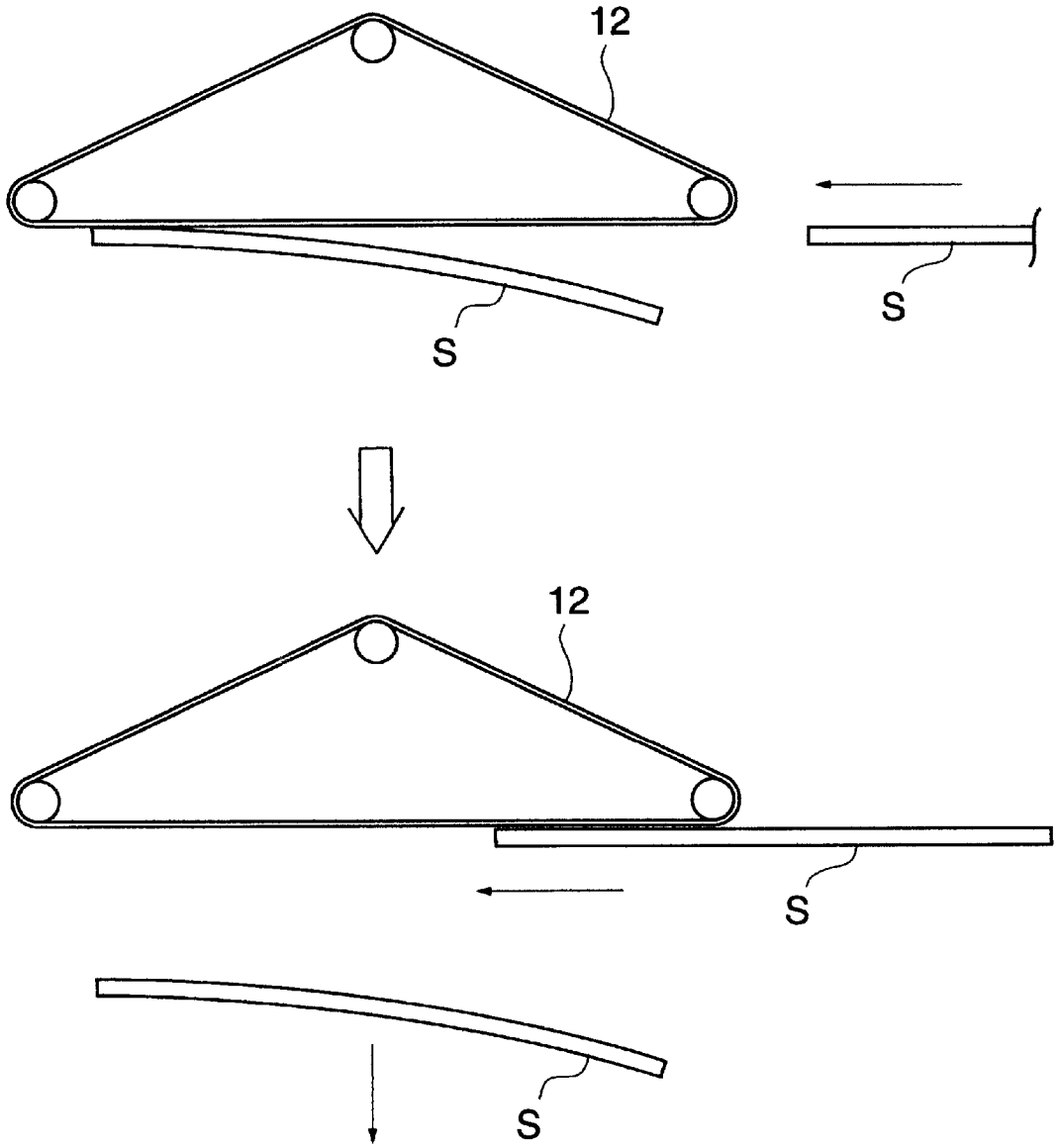
FIG. 17 is a schematic drawing for the purpose of describing the present invention.

Referring to FIG. 17, a schematic showing suction belt 12 releasing sheet S is shown. Sheet S is separated from suction belt 12 at a position above hopper 2 (not shown). Sheet S falls into hopper 2 (not shown) a tailing end of sheet S lower than a leading end of sheet S. This orientation prevents sheet S from entering the hopper front-end first. Problems, such as jams, are minimized and reliable sheet stacking is possible when sheets S are dropped from suction belt 12 with the tailing end lower than the leading end. Since suction belt 12 only applies localized suction to a section of sheet S between the leading end and the central region, sheet S is easily separated from suction belt 12, minimizing damage to sheet S during separation. Furthermore, since sheet S is conveyed while suctioned with negative pressure to suction belt 12, conveyance is more reliable than with sandwich belt conveyors.

Figure 12A:
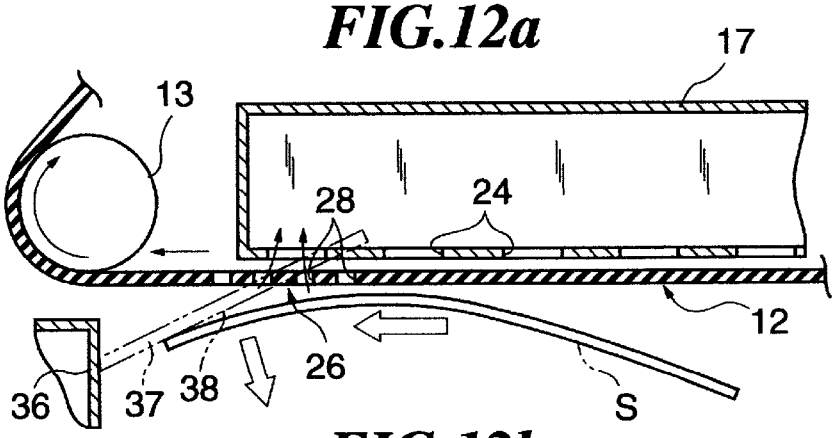
FIGS. 12*a*, 12*b*, and 12*c* are drawings for the purpose of describing the suction conveyor and the scraper positioned at the terminal end region thereof.
Figure 12B:
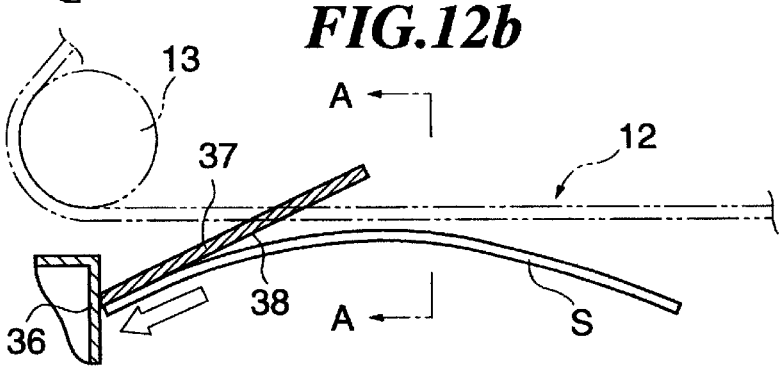
Figure 12C:
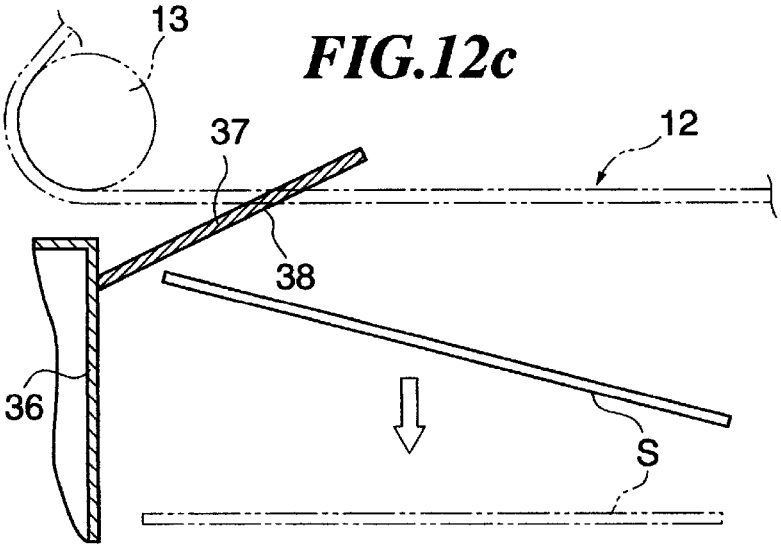

Referring to FIG. 12, scraper 37 is located between multiple suction belts 12. Scraper 37 includes a peeling guide surface 38 which slopes in the upstream direction relative to a surface parallel to the sheet conveyance direction. Peeling guide surface 38 projects up from the belt conveyance surface and forcibly peels sheets from suction hole sets 26 of suction belts 12.

Figure 13A:
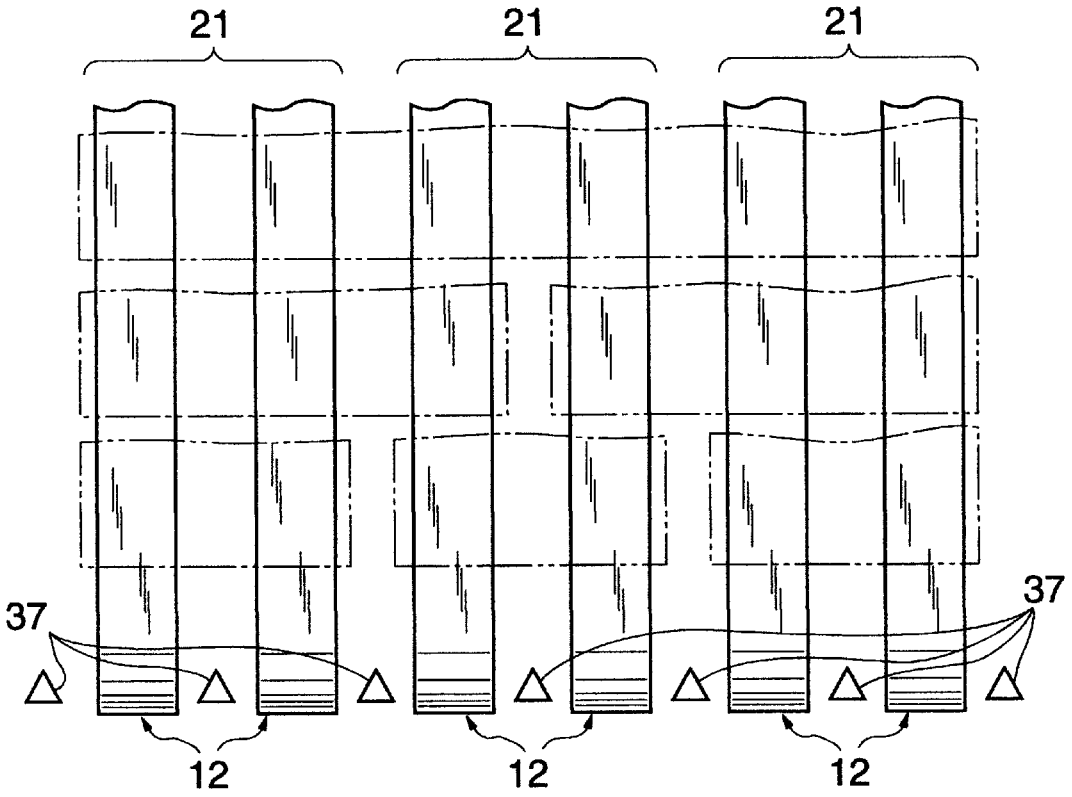
FIG. 13*a* is a schematic drawing showing an example of how the suction belt and the scraper can be arranged.
Figure 13B:
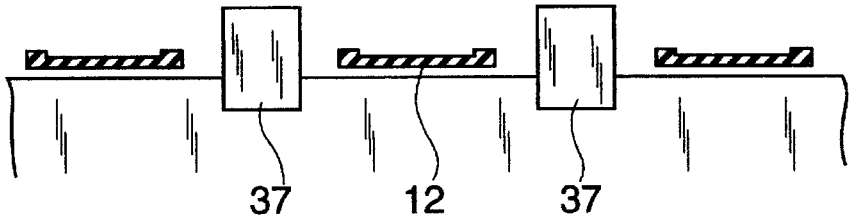
FIG. 13*b* is a view along A—A of FIG. 12*b*.

Referring to FIGS. 13*a* and 13*b*, a single suction unit 21 includes a set of two suction belts 12. For each suction unit 21, multiple scrapers 37 are arranged side by side. For example, when three suction units 21 are disposed side by side, scrapers 37 are arranged in a row parallel to the row of suction units 21 to form a scraper set. In another embodiment, scrapers 37 are disposed at either side of suction belt 12. FIG. 13*b* shows scrapers 37 and suction belts 12 as viewed along the A—A line of FIG. 12*b*. By having three suction units 21 arranged side by side in the manner of FIGS. 13*a* and 13*b*, one, two, or three-piece sheets can be conveyed side by side simultaneously.

Referring back to FIGS. 12*a*, 12*b*, and 12*c*, sheet S is attached to suction belt 12 by air suctioned through suction holes 28. As suction belt 12 moves, the leading end of sheet S rides up on peeling guide surface 38 of scraper 37. Sheet S gradually disengages from suction belt 12 along inclined peeling guide surface 38. As suction belt 12 moves further, the leading end of sheet S disengages from suction hole set 26, causing the negative-pressure suction from suction belt 12 to cease acting upon the leading end of sheet S. The inertia of sheet S causes the leading end of sheet S to contact stopper 36. Sheet S then falls into hopper 2 from its own weight. The trailing end of sheet S falls before the leading end.

Figure 14:
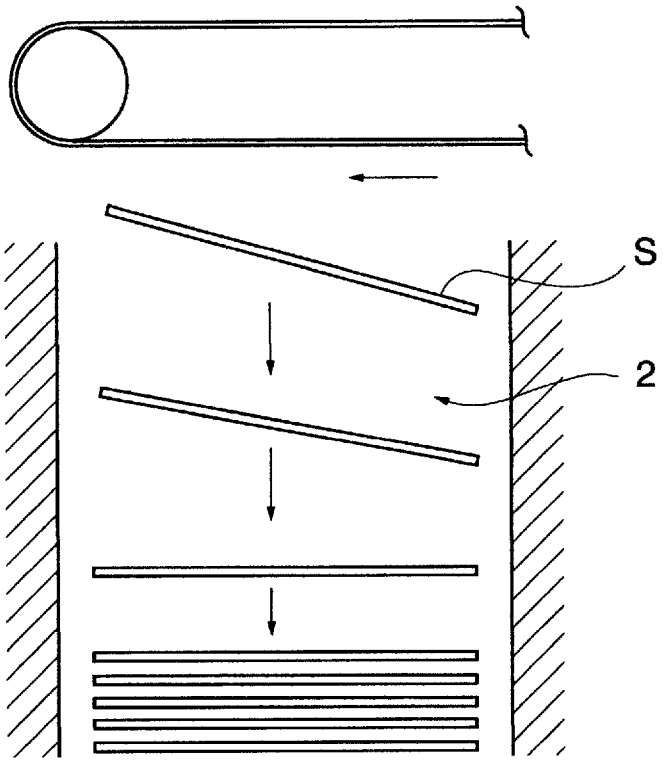
FIG. 14 is a drawing for the purpose of describing the advantages of this embodiment.
Figure 15:
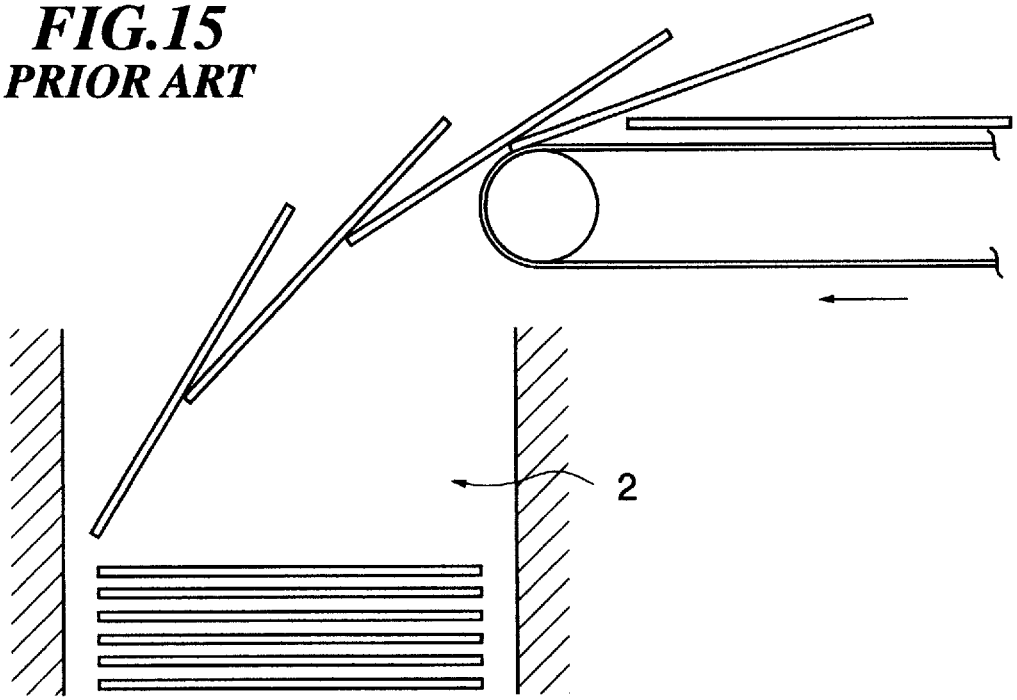
FIG.15 PRIOR ART
FIG. 15 is a schematic drawing showing problems associated with the conventional technology.

Referring to FIGS. 14 and 15, sheet S falls to hopper 2 while tilted so that the trailing end is below the leading end. Thus, sheet S is not dropped into hopper 2 tilting forward, as in the conventional technology shown in FIG. 15. Jams are prevented by having the trailing end tilted below the leading end.

Figure 16A:
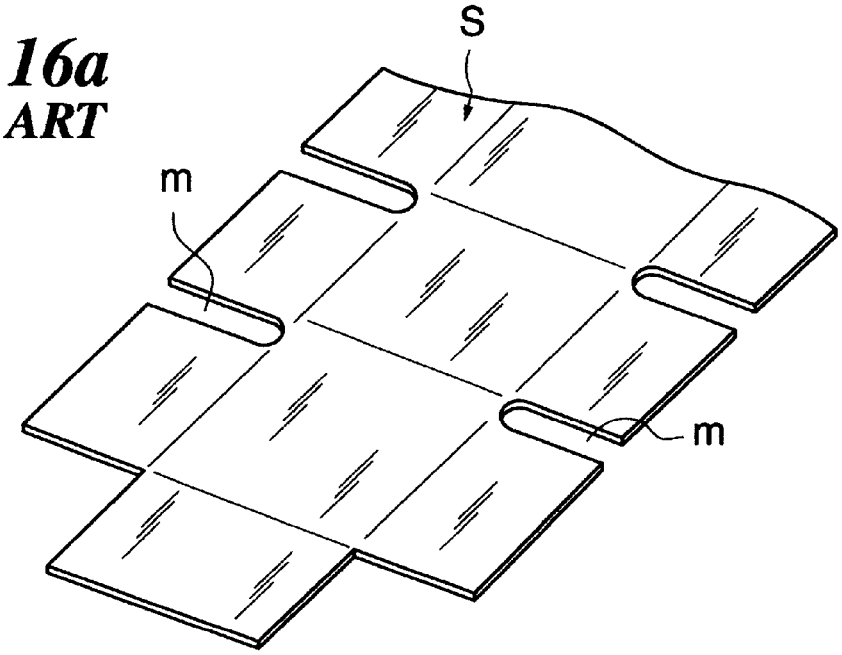
FIG.16a PRIOR ART
FIG. 16*a* is a drawing for the purpose of describing the specific form of the sheet.
Figure 16B:
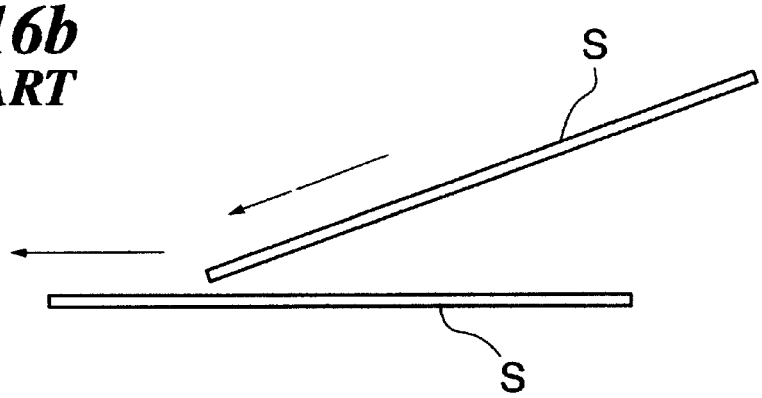
FIG.16b PRIOR ART
FIGS. 16*b* and 16*c* show stacking methods according to the conventional technology and this embodiment.

Referring to FIGS. 16*a* and 16*b*, sheet S can be, for example, cut in the shape of an open box having grooves m between flaps. In the conventional method, grooves m of the uppermost sheet S in hopper 2 (not shown) may get caught with the leading end or grooves m of the next sheet S, resulting in a jam.

Figure 16C:
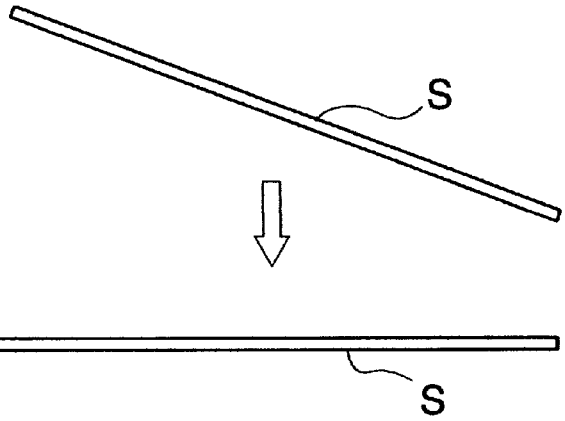

Referring to FIG. 16*c*, in this embodiment of the present invention, jams are prevented by having the trailing end of sheet S tilted below the leading end of sheet S. Furthermore, since suction belt 12 applies negative pressure suction locally to only the leading end of sheet S, sheet S is easily separated from suction belt 12.

Referring back to FIG. 2, hopper 2 in which sheets S are stacked as described above also includes partitioning shafts 40 projecting horizontally at different heights. Corresponding cylinders 41 extend and retract partitioning shafts 40 into hopper 2. In a preferred embodiment, partitioning shafts 40 are the piston rods of cylinders 41.

Figure 3:
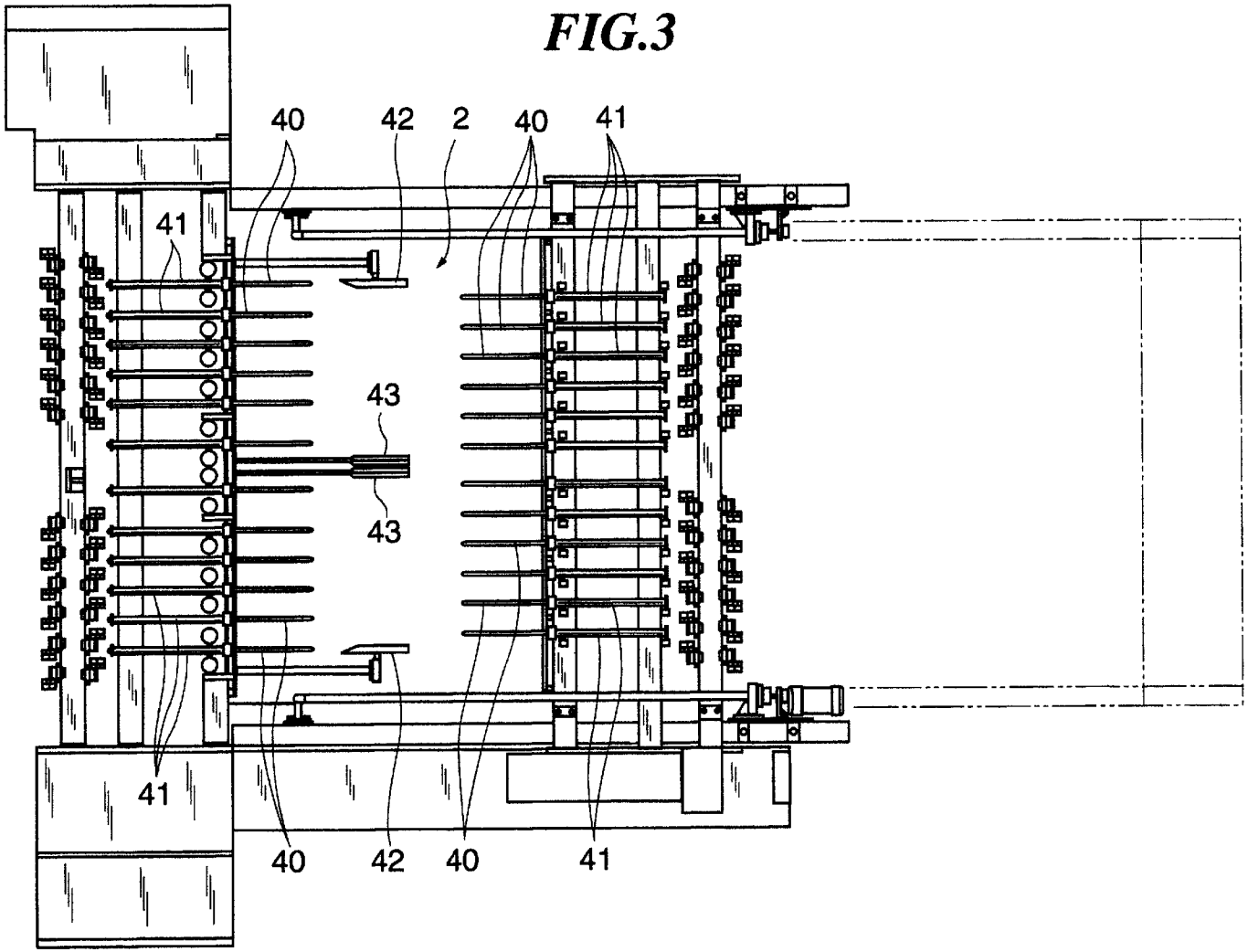
FIG. 3 is an enlarged plan drawing showing the hopper from FIG. 2.

Referring to FIG. 3, two levels of partitioning shafts 40 project into hopper 2 in a combtooth arrangement. Partitioning shafts 40 of the upper level or the lower level are selectively projected to define boundaries of, for example, a prescribed number of sheets.

Side plates 42 are driven by a drive device (not shown in the figure) to move toward and away from each other according to the lateral dimension of sheets S. Side plates 42 provide alignment of sheets S in the direction perpendicular to the conveyance direction. In another embodiment of the present invention, if sheets S are two-piece sheets stacked side by side, a pair of central side plates 43 at a central section of hopper 2, together with side plates 42, provide lateral alignment of sheets S. If the sheets are one-piece sheets, central side plates 43 are recessed to a position where they do not interfere with the stacking. Central side plates 43 are also removable from hopper 2.

Figure 18:
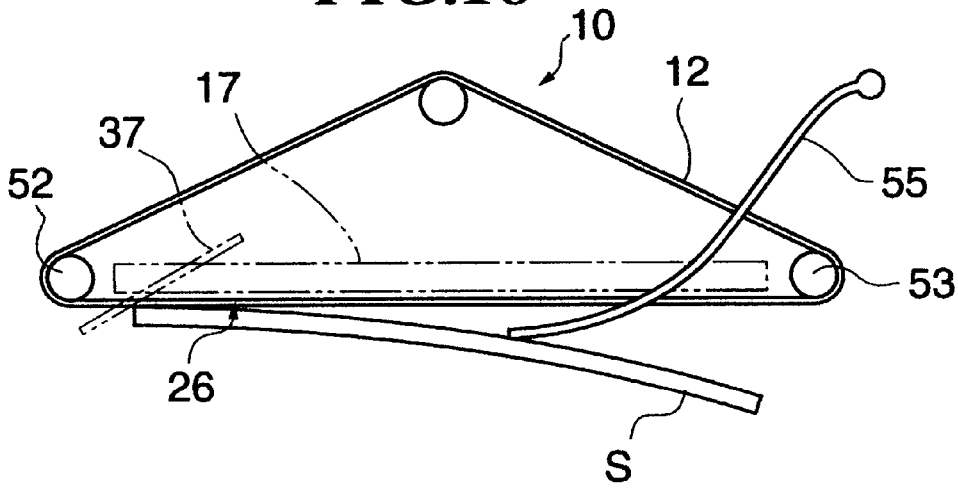
FIG. 18 is a drawing for the purpose of describing a first example of a dropped-sheet guiding device.

Referring to FIG. 18, an alternative embodiment of the present invention includes a dropped sheet guiding device 55 (which could also be referred to as a sheet-dropping auxiliary device or assisting device) to guide the dropping of sheet S in an orientation where the trailing end is lower than the leading end. Dropped-sheet guiding device 55 has a fixed base end. The other end of droppedsheet guiding device 55 is a free end in the form of, for example, an appropriate number of plate springs interposed between suction belts 12. The downward force exerted by these plate springs that make up dropped-sheet guiding device 55 is less than the negative pressure suction applied to sheets S through suction hole sets 26 of suction belt 12.

The leading sections of sheets S conveyed by this type of suction conveyor 10 are suctioned in a localized manner by suction hole sets 26 of suction belt 12. When the leading sections of sheets S pass dropped-sheet guide device 55, the plate springs are elastically deformed upward to press against the top surface of sheet S, allowing sheet S to pass. The trailing section of sheet S, upon which suction from suction belt 12 is not applied, approaches the plate springs. The plate springs elastically press against this non-suctioned sheet region, pushing this region away from suction belt 12. The resulting sheet S is oriented with the trailing section lower than the leading section. When sheet S reaches the end region of suction conveyor 10, sheet S disengages from suction hole sets 26 of suction belt 12 by scrapers 37.

Dropped sheet guiding device 55 returns downward to its original position. The resulting sheet S falls into the hopper with the trailing end falling before the leading end.

Figure 19:
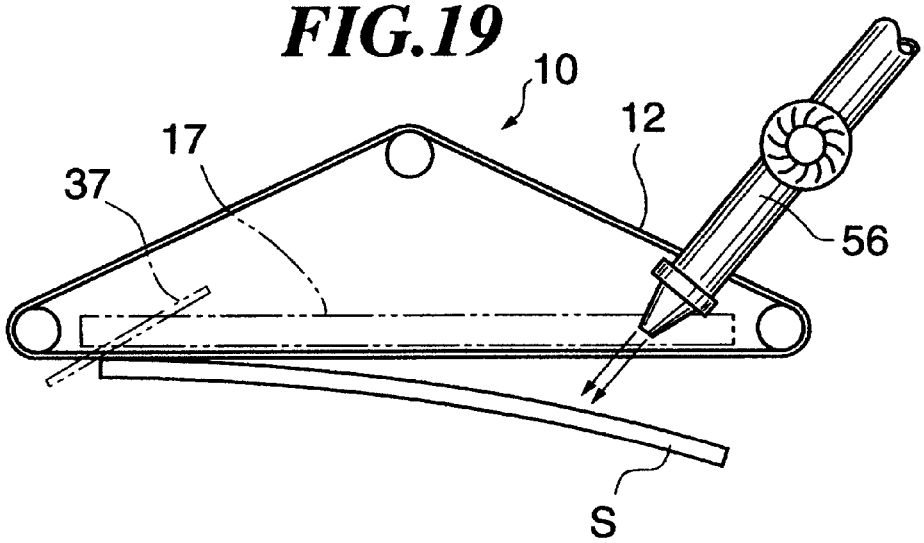
FIG. 19 is a drawing for the purpose of describing a second example of a dropped-sheet guiding device.

Referring to FIG. 19, an alternate embodiment of the dropped-sheet guiding device is shown. A dropped-sheet guiding device 56 blows pressurized air onto the non-suctioned region of the top surface of sheet S. Dropped-sheet guiding device 56 includes air-blowing apertures interposed between suction belts 12. Dropped-sheet guiding device 56 is recessed upward from the lower conveyance surface of suction belt 12 at least when a sheet passes. Sheet S is conveyed to the terminal end region of suction conveyor 10 while having its leading end being suctioned by suction hole sets 26 of suction belt 12. Sheet S is then separated from suction belt 12 by scrapers 37. Prior to or at the same time as this separation, dropped-sheet guiding device 56 begins blowing pressurized air to the top surface of the trailing end of sheet S. The pressurized air facilitates the dropping of the trailing end of sheet S before the leading end. The air can be left blowing continuously if the pressure from the air to push away the sheet from suction belt 12 is lower than the negative pressure suction applied to sheet S by suction hole set 26 of suction belt 12.

Figure 20:
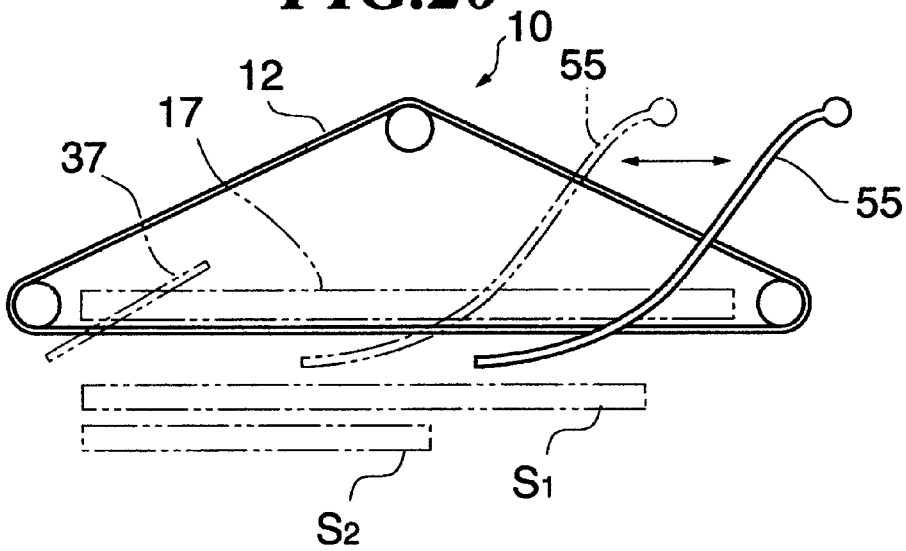
FIG. 20 is a drawing for the purpose of describing a third example of a dropped-sheet guiding device.

Referring to FIG. 20, dropped-sheet guiding device 55, is horizontally adjustable according to the length of the sheets to be conveyed. In other words, dropped-sheet guiding device 55 can be moved along the axis connecting the starting end and the terminal end of suction conveyor 10. For example, with a relatively long sheet, such as a sheet S1, dropped-sheet guiding device 55 is positioned toward the starting end of suction conveyor 10. With a relatively short sheet such, as a sheet S2, dropped-sheet guiding device 55 is moved to approach the terminal end of suction conveyor 10. Subsequent operations are the same as those described for FIG. 18. The moving mechanism can be a cylinder, a rack and pinion system, a bolt with an adjustment hole, or the like.

Figure 21:
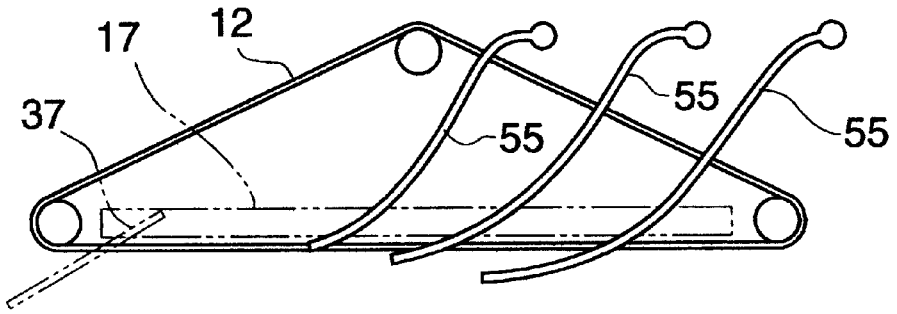
FIG. 21 is a drawing for the purpose of describing a fourth example of a dropped-sheet guiding device.

Referring to FIG. 21, multiple dropped-sheet guiding devices 55, such as those formed from plate springs shown in FIG. 18, are disposed at prescribed intervals along the direction in which the sheets are conveyed. The trailing, non-suctioned end of sheets of considerable length are effectively separated from suction belt 12 by having an appropriate number of laterally arranged droppedsheet guiding devices 55 interposed between suction belts 12. Sheets of considerable width are effectively separated from suction belt 12 by having multiple suction units 21 (not shown, see FIG. 13*a*), each having an appropriate number of laterally arranged dropped-sheet guiding devices 55 interposed between suction belts 12. Even if the sheets are not very long, multiple dropped-sheet guiding devices 55 can facilitate the dropping of the trailing end of the sheets before the leading end. With multiple dropped-sheet guiding devices 55 separation from suction belt 12 is effected over a wide range, from the central region to the trailing end of the sheets.

Figure 22:
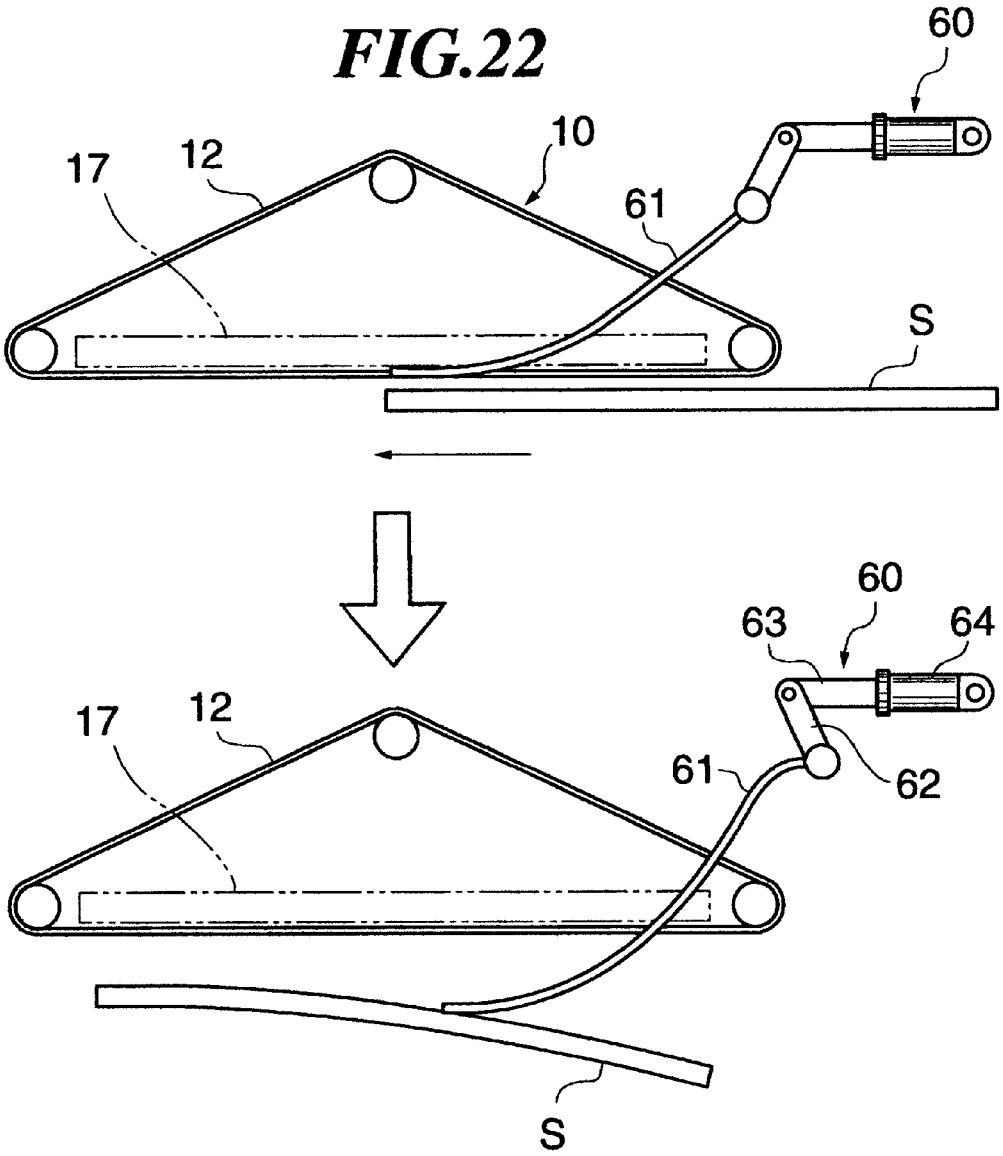
FIG. 22 is a drawing for the purpose of describing a fifth example of a dropped-sheet guiding device.

Referring to FIG. 22, a sheet-peeling device 60 is disposed to firmly separate the non-suctioned trailing end of the sheet from suction belt 12 using an actuator. Sheet-peeling device 60 provides more aggressive separation compared to the use of fixed plate springs or air blowers. Sheet-peeling device 60 includes at least one peeler section 61 having flexure or elasticity positioned between suction belts 12. Peeler section 61 is connected to a piston rod 63 of a cylinder 64 by a connecting member 62. In an inactive state, peeler section 61 is positioned at the suction region of suction belt 12. When cylinder 64 is activated, peeler 61 moves downward to apply a force to the non-suctioned trailing section of sheet S. Thus, when the suctioned end of sheet S separates from suction conveyor 10, sheet S separates and drops from suction belt 12 with the trailing section dropping before the leading section.

Figure 26:
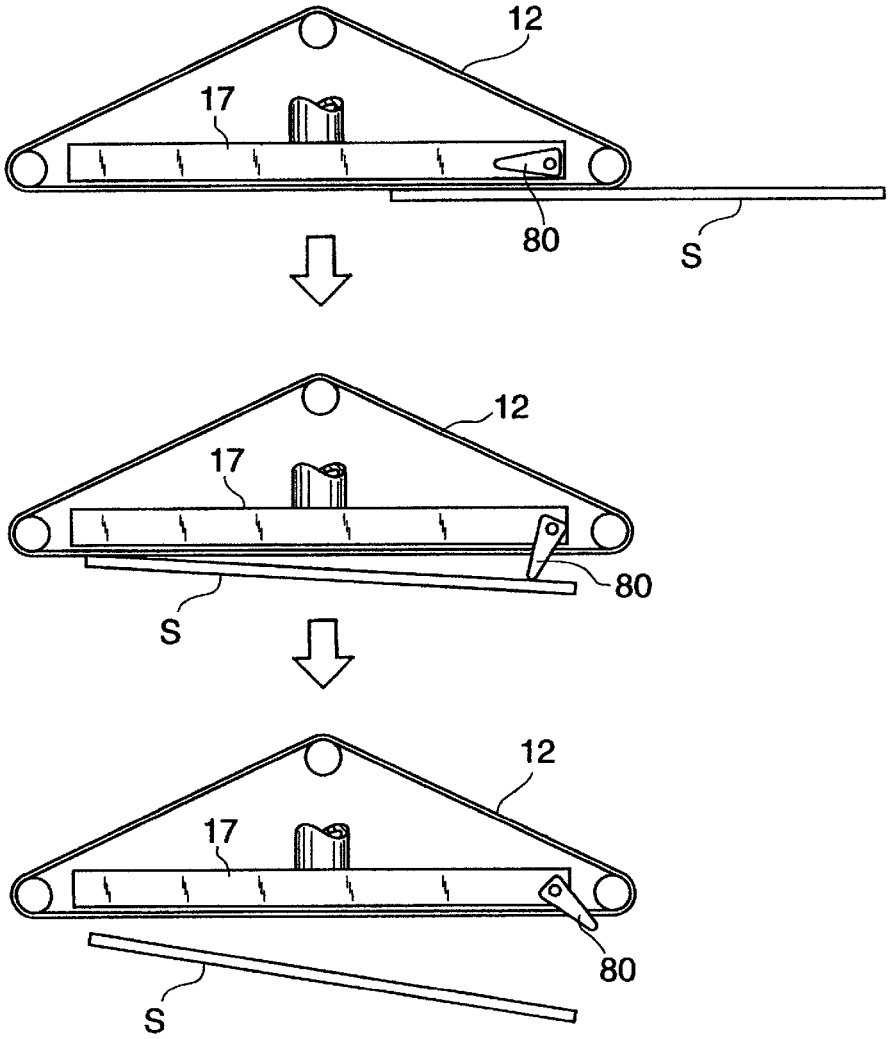
FIG. 26 is a drawing for the purpose of describing how a cam is used to separate the trailing section of the sheet from the suction belt.
Figure 27:
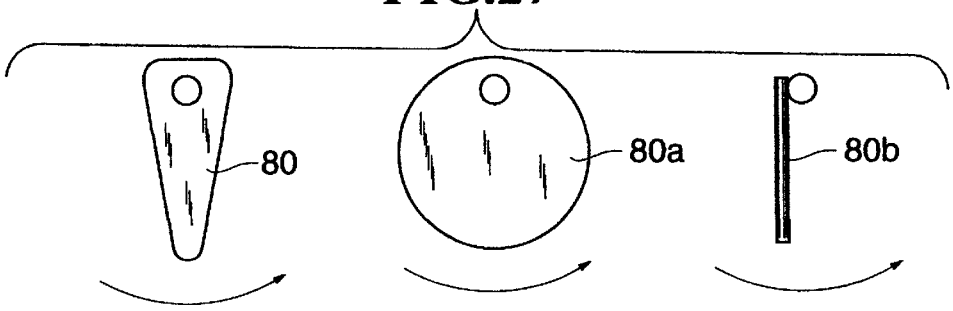
FIG. 27 is a drawing showing another example of a cam.

Referring to FIGS. 26 and 27, in another embodiment of the present invention, a rotating cam 80 is rotated downward from a recessed position (inactive position) to forcibly separate the trailing section of sheet S from suction belt 12. Various types of cams can be used to separate sheet S from suction belt 12. Preferably, cams 80, 80*a*, and 80*b* are used in this embodiment of the present invention.

In the description above, the leading end of the sheet is locally suctioned by the suction hole sets 26 of suction belt 12. However, it is possible to have local suction applied to any section of the sheet between the leading end and the central region.

Figure 23:
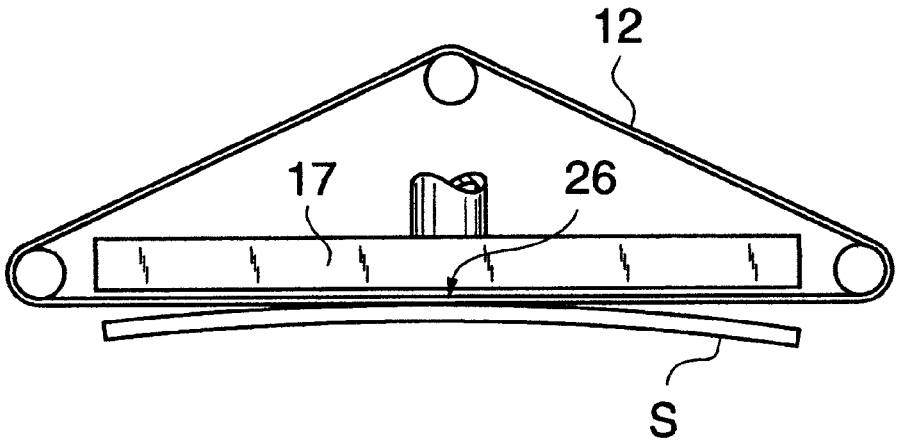
FIG. 23 is a figure showing an example of how the central section of the sheet is suctioned.

Referring to FIG. 23, suction hole sets 26 of suction belt 12 apply suction to a central region of sheet S. In order to apply suction to a central region of sheet S, a registration device is attached to offset the phase of suction hole sets 26. For example, the drive force of a motor used to cycle suction belt 12 can transfer a drive force to suction belt 12 via a harmonic drive or the like. A registration motor driving this harmonic drive is appropriately activated to adjust the cycling speed of suction belt 12 via the harmonic drive. This kind of registration device can also be used to adjust the speed of the conveyor upstream from suction belt 12. If there is arching in sheets S, the leading end may be more difficult to suction. In such cases, suctioning the central region is preferred.

Figure 24:
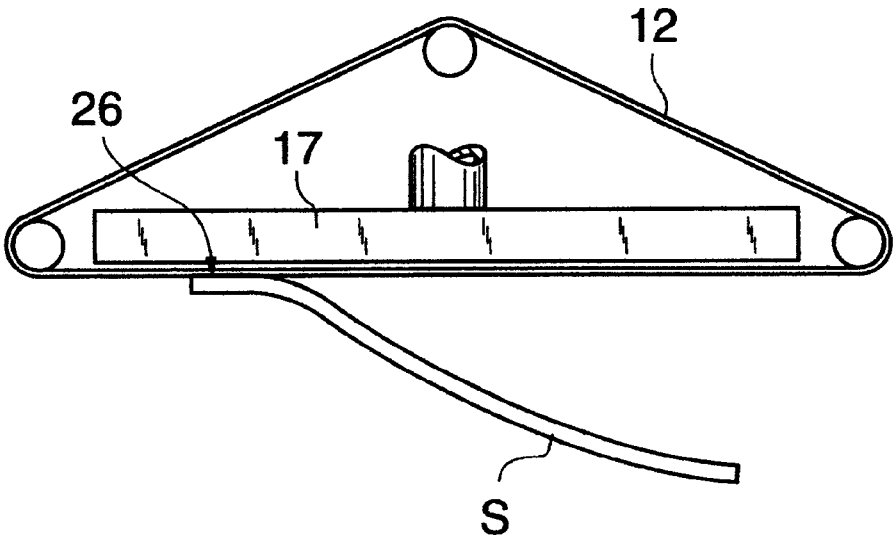
FIG. 24 is a figure showing an example of why the central section of the sheet is suctioned.

Referring to FIG. 24, if the quality of the sheet material is bad and sheets S are flimsy or thin, suctioning of the leading end of sheet S while conveying may form bends in the leading region of sheet S as shown in FIG. 24. This bending is minimized by having suction applied to a central region of sheet S. Also, with low-quality or thin sheets, suctioning the leading end can result in damage to the sheet during separation. The problem of sheet tearing is minimized by applying localized suction to a central region of sheet S. Furthermore, with sheets that are arched, suctioning the leading end of sheet S requires significant suction power. However, sheets with prominent arching can be conveyed by suctioning a central region of the sheet without using significant suction power. A registration device offsets the phase of suction hole sets 26 to align suction hole sets 26 with a central region of the sheet. This prevents requiring large negative-pressure suction equipment.

In order to feed sheets so that the leading ends or the central sections align with suction hole sets 26, the conveyance speed is the same as that of the conveyor upstream from suction belt 12. The conveyance timing is also synchronized.

Figure 25:
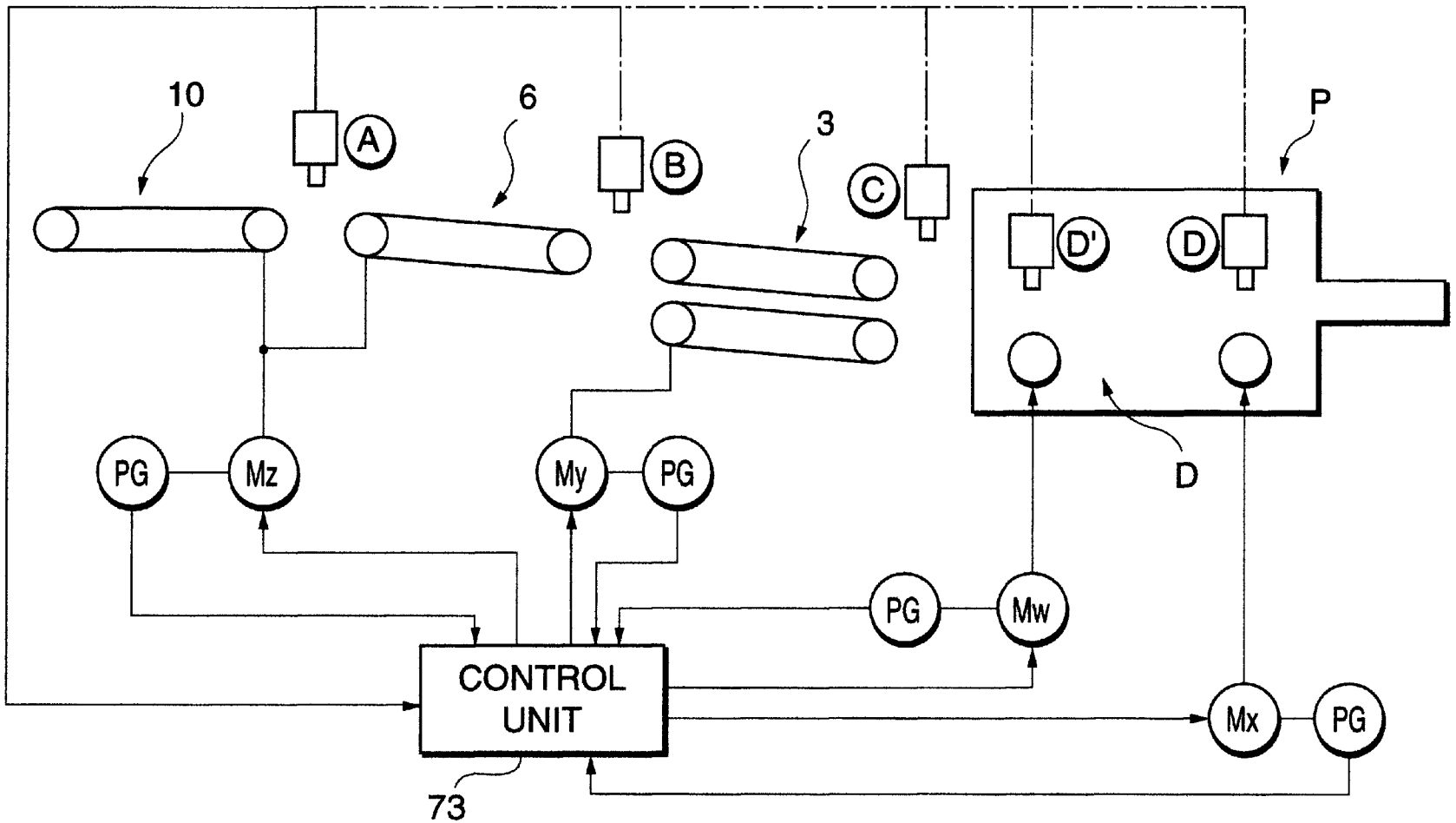
FIG. 25 is a schematic drawing showing an example of the entire control system.

Referring to FIGS. 4*c* and 25, a processing machine (not shown) is located upstream (to the right in FIG. 25) from a printer P. A die cutter D is disposed downstream from printer P. Vibration conveyor 3, separator conveyor 6, and suction conveyor 10 are located, in that order, downstream from die cutter D. Printer P and die cutter D are driven by motors Mx and Mw. Vibration conveyor 3 is driven by a motor My. Separator conveyor 6 and suction conveyor 10 of the present invention are driven by a motor Mz. The speeds of motors Mw, Mx, My, and Mz are detected by rotation speed sensors PG in the form of pulse generators or the like. Motors Mw, Mx, My, and Mz are driven by drive signals from a control section 73. The rotation speeds of motors Mw, Mx, My, and Mz are fed back to control section 73 by rotation speed sensors PG.

Printer P, vibration conveyor 3, separator conveyor 6, and suction conveyor 10 are synchronously controlled. Suction hole sets 26 of suction belt 12 are always kept aligned with the sheet suction section (e.g., the leading section). Sensors A–D and D' are disposed to sense sheet position. The resulting sheet detection positions are compared by control section 73 with a rotation speed signal (PG) from the drive section (Mz) of section conveyor 10. Suction conveyor 10 is controlled based on this signal. More specifically, for example, sensor A senses the sheet position at the terminal end region of conveyor 6, upstream from and next to suction conveyor 10. The sheet position is sent to control section 73. Control section 73 uses the position provided by sensor A to compare the distance to suction conveyor 10 with the cycling phase of suction hole sets 26 of suction conveyor 10. Based on this comparison, control section 73 speeds up or slows down conveyor 6 or, alternatively, speeds up or slows down suction conveyor 10 so that a particular section of the sheet (e.g., the leading section) is suctioned by suction hole sets 26 of suction belt 12.

Sensor A is positioned immediately before suction conveyor 10, and therefore provides the most accurate sheet position in terms of its relation with suction hole sets 26 of suction belt 12. However, since sensor A is positioned immediately before suction conveyor 10, speed correction for suction conveyor 10 may lack adequate responsiveness. Thus, sensors B, C, D, and D' can also be used. For example, sensor B, at the exit of vibration conveyor 3, is used to control drive motor Mz of suction conveyor 10 (in addition to motor Mz, or instead of motor Mz, drive motor My of separator conveyor 6 may also be controlled). In place of or in addition to sensor B, sensor C is used to sense sheet position at the entry to vibration conveyor 3. Sensor D' is used to sense sheet position at the exit of die cutter D. Each of these positions determines the distance to suction conveyor 10 and assists with the alignment of the sheet with specific suction hole sets 26 of suction belt 12. Furthermore, sensor D senses the sheet position at the exit of printer P. Sensor D similarly aligns suction hole sets 26 of suction belt 12 to a specific section (the leading end, a central section, or the like) of the sheet. If a fine level of control is needed, all sensors A–D and D' are used. The sheet position signals sensed by sensors A–D and D' are used to drive the drive sections (the motors Mw, Mx, My, and Mz) and control the alignment of the sheet with specific suction hole sets 26 of suction belt 12. In this arrangement, a fine level of control is provided with motor Mw driving only die cutter D. It is also possible to have motor Mx drive both die cutter D and printer P.

In the example described above, at least one of sensors A–D and D' feeds sheet position signals to control section 73. However, it is also possible, instead of using sensors A–D and D', to synchronize (align) suction hole sets 26 of suction belt 12 with the sheet position through an open control method. In this method, the detected rotation speeds for each of drive motors Mw, Mx, My, and Mz is adjusted to align the sheets with suction hole sets 26 of suction belt 12.

Suction conveyor 10 and suction belt 12, according to the present invention, is used for a hopper disposed downstream from a printer slotter or a flexographic printer slotter. In addition, suction conveyor 10 and suction belt 12 of the present invention can be used for deflector conveyors such as corrugators, and sheet conveying devices such as corrugators.

Figure 28:
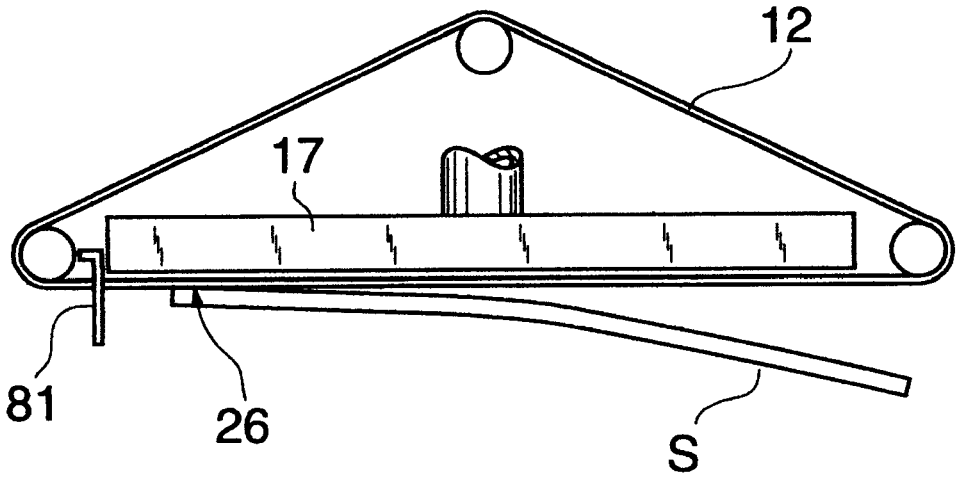
FIG. 28 is a drawing showing an example of how a stopper is used to free the sheet from the suction belt.

Referring to FIG. 28, in another embodiment of the present invention, it is possible to stop the forward motion of sheet S using a stopper 81. Stopper 81 comes into contact with the leading end of sheet S at the terminal end of the sheet conveyance path. At the same time, the cycling of suction belt 12 is continued to move suction hole sets 26 of suction belt 12 away from the leading end of sheet S. The continued rotation of suction belt 12 removes the negative-pressure suction acting on sheet S, thereby removing the support for sheet S, which thereupon drops. Stopper 81 is disposed between suction belts 12 around the terminal end of the sheet conveyance path. Scrapers 37 (not shown, see FIGS. 12*a*, 12*b*, and 12*c*) are eliminated in this arrangement.

Figure 29:
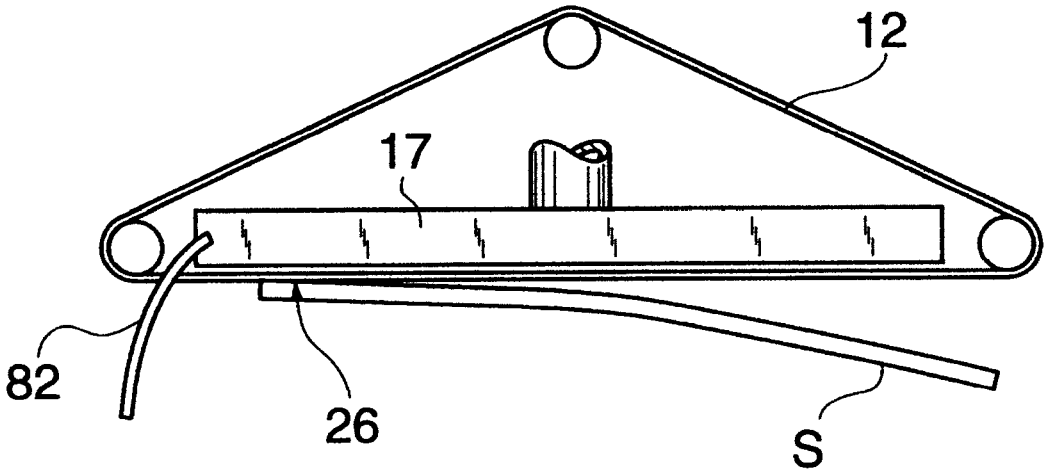
FIG. 29 is a drawing showing how a scraper/stopper is used to free and align the sheet.
Figure 30:
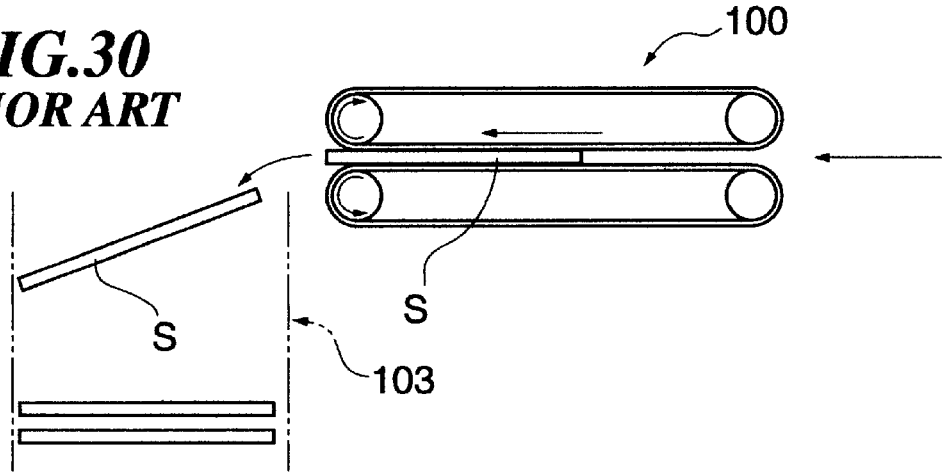
FIG.30 PRIOR ART
FIG. 30 is a drawing of a conventional sandwich-belt conveying device.
Figure 31:
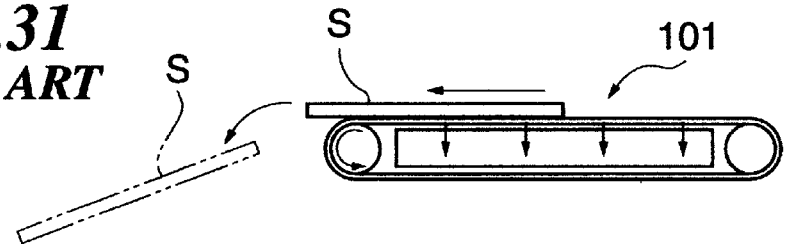
FIG.31 PRIOR ART
FIG. 31 is a drawing of a conventional suction conveyor that applies suction to the upper surface.
Figure 32:
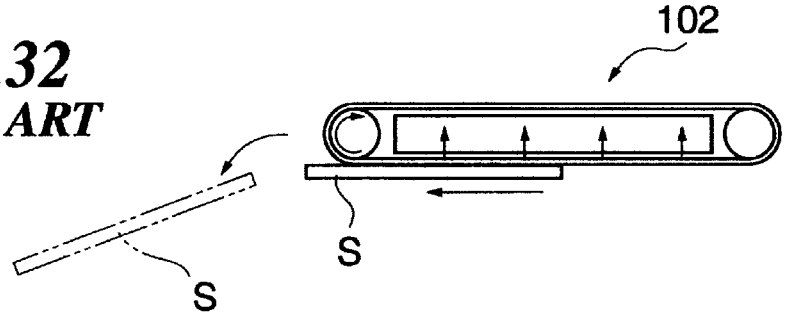
FIG.32 PRIOR ART
FIG. 32 is a drawing of a conventional suction conveyor that applies suction to the lower surface.
Figure 33:
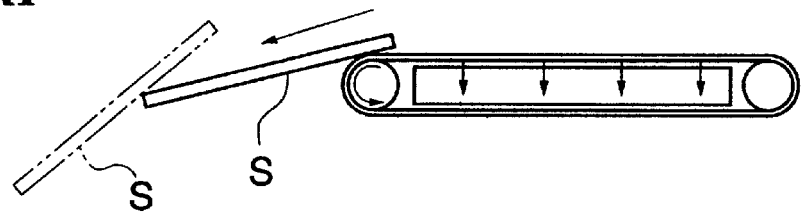
FIG.33 PRIOR ART
FIG. 33 is a drawing for the purpose of describing the problems of the conventional technology.
Figure 34:
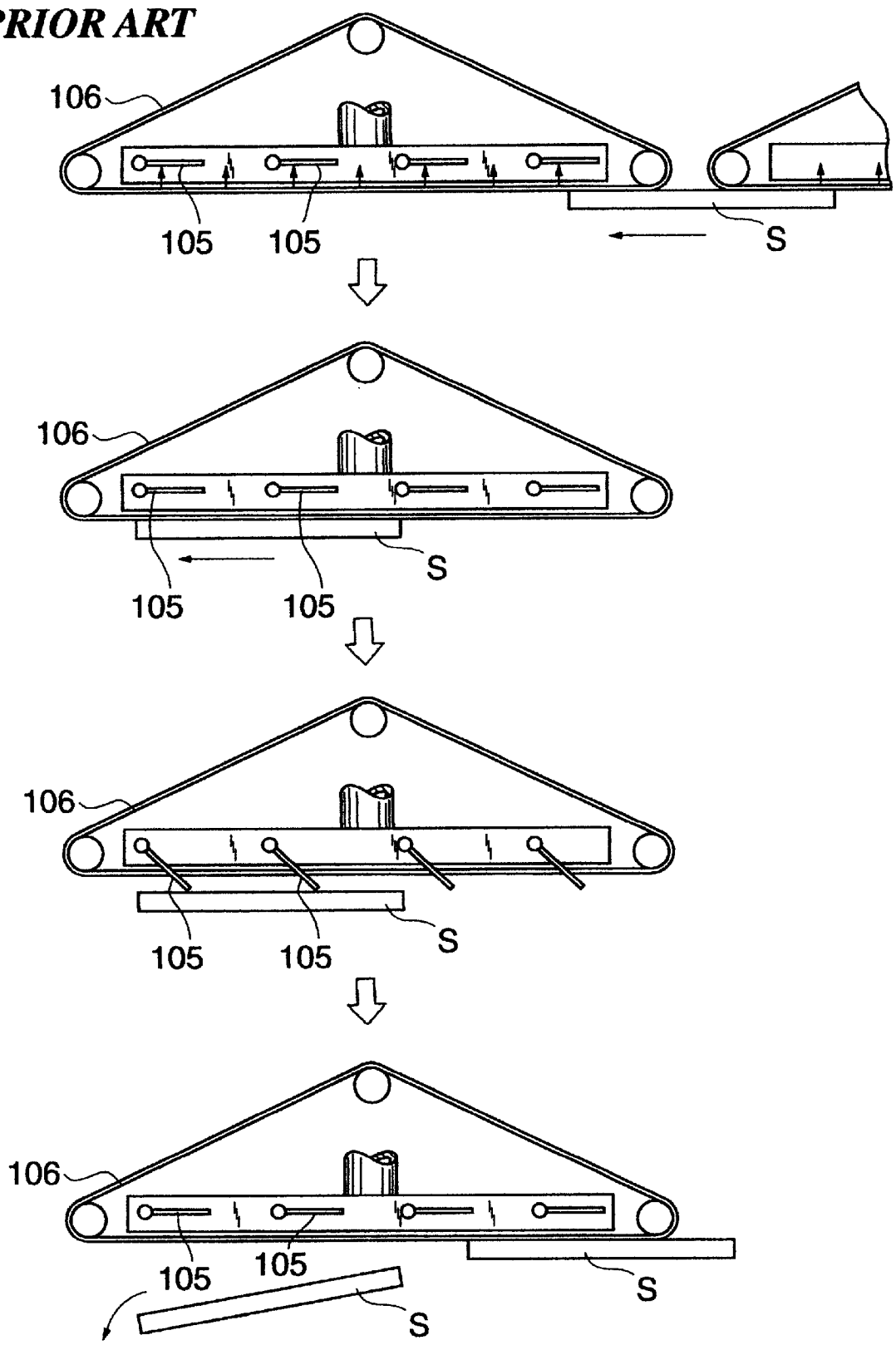
FIG.34 PRIOR ART
FIG. 34 is a drawing for the purpose of describing the problems of the conventional technology from a different angle.

Referring to FIG. 29, it is also possible to have a scraper/stopper 82 disposed at the terminal end of the sheet conveyance path. Scraper/stopper 82 peels off the suctioned leading end of sheet S from suction belt 12 while stopping its forward motion. Scraper/stopper 82 is formed with an arcuate section that peels the leading end of sheet S from suction belt 12 while stopping its forward motion.

In the embodiments described above, suction belt 12 is formed with suction hole sets 26 disposed at a prescribed pitch. However, it is also possible to use a suction belt having suction hole sets formed over its entire perimeter. In this case, the sheet will be suctioned to the suction belt through uniform suction rather than localized suction.

Referring to FIG. 22, when the trailing end of the uniformly suctioned sheet S approaches, plate spring 61 or the like contacts the trailing end of sheet S using sheet peeling device 60. This forces the trailing end of sheet S to drop down before the leading end.

Referring to FIG. 26, rotating cam 80 separates the trailing section of sheet S uniformly suctioned to suction belt 12, resulting in the trailing end dropping down before the leading end.

Referring to FIG. 19, it is also possible to use dropped-sheet guiding device 56 instead of plate spring 61 and cam 80. Dropped-sheet guiding device 56 applies air pressure to the trailing end of sheet S, resulting in the same rearward tilting when sheet S drops down into hopper 2 (not shown). In this case, however, the downward force of air pressure must be sufficient to separate the trailing end of sheet S from the suction force.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A sheet stacking device for conveying and stacking at least first and second sheets comprising:

a suction box;

a suction belt;

at least a portion of said suction belt passing in contact with said suction box;

at least a portion of said suction belt having porous sections whereby a suction in said suction box is communicated for suction holding of said first sheet moving thereon;

means for separating said first sheet from said suction belt;

said second sheet being conveyed spaced from and following said first sheet on said suction belt;

said means for separating being further effective for separating said second sheet from said suction belt; and at least one of said suction belt and said means for separating including orienting means for discharging said first sheet with its trailing end lower than a leading end of said first and second sheet, whereby said leading end of said second sheet passes over said trailing end of said first sheet and jamming of said first and second sheets is avoided.

2. A sheet stacking device according to claim 1, wherein:

said suction belt has a plurality of porous sections separated by nonporous sections, whereby a suction in said suction box is communicated for suction holding of said first and second sheets moving thereon;

a pitch of porous sections exceeding a length of said first and second sheets;

said means for separating includes a stopper stopping a forward motion of said sheet while said suction belt continues to move; and said stopping of said forward motion causing said porous section to move past said sheet, releasing said suction holding.

3. A sheet stacking device according to claim 1, wherein:

said orienting means includes a rotating cam; and a portion of said rotating cam rotatably projects from a region adjacent to said suction belt to press against said trailing end of said sheet, thereby discharging said first sheet with its trailing end lower than a leading end of said first sheet, whereby said leading end of said second sheet passes over said trailing end of said first sheet and jamming of said first and second sheets is avoided.

4. A sheet stacking device according to claim 1, wherein:

said means for separating includes a scraper; and said scraper forcing a leading end of said first and second sheets from said suction belt.

5. A sheet stacking device according to claim 1, wherein:

said means for separating includes a scraper/stopper;

said scraper/stopper having an arcuate section which peels said leading end of said first and second sheets from said suction belt while stopping a forward motion of said first and second sheets; and said stopping of said forward motion causing said porous section to move past said first and second sheets, releasing said suction holding.

6. A sheet stacking device according to claim 1, further comprising at least one additional suction belt parallel and spaced away from said suction belt.

7. A sheet stacking device according to claim 1, wherein said orienting means includes at least one of a blower and a mechanical device for preferentially pushing downward a trailing end of said first and second sheets.

8. A sheet stacking device according to claim 7, wherein:

said mechanical device includes an elastically deformable free end extending below said suction belt; and said free end resiliently pressing against a top surface of said trailing end of said sheets when said forward motion stops and said suction holding is released, thereby discharging said first sheet with its trailing end lower than a leading end of said first sheet, whereby said leading end of said second sheet passes over said trailing end of said first sheet and jamming of said first and second sheets is avoided.

9. A sheet stacking device according to claim 7, wherein:

said blower includes air blowing apertures; and said air blowing apertures providing an air pressure against a top surface of said trailing end of said sheets when said forward motion stops and said suction holding is released, thereby discharging said first sheet with its trailing end lower than a leading end of said first sheet, whereby said leading end of said second sheet passes over said trailing end of said first sheet and jamming of said first and second sheets is avoided.

10. A sheet stacking device according to claim 4, wherein:

said means for separating includes a sheet peeling device;

said sheet peeling device having at least one peeler section and at least one actuator;

said at least one peeler section elastically positioned above said suction belt; and said actuator providing means for a downward movement of said at least one peeler section, applying a force to a top surface of said sheet, releasing said suction holding, and thereby discharging said first sheet with its trailing end lower than a leading end of said first sheet, whereby said leading end of said second sheet passes over said trailing end of said first sheet and jamming of said first and second sheets is avoided.

11. A sheet stacking device for conveying and stacking at least first and second sheets comprising:

a suction box;

a suction belt;

said suction belt having a plurality of porous sections separated by nonporous sections, whereby a suction in said suction box is communicated for suction holding of said first and second sheets moving thereon;

a pitch of porous sections exceeding a length of said first and second sheets;

means for separating said first sheet from said suction belt;

said second sheet being conveyed spaced from and following said first sheet on said suction belt;

said suction being applied only to a leading end of said first and second sheets, thereby conveying each sheet with a trailing end of each sheet lower than said leading end;

said means for separating being further effective for separating said second sheet from said suction belt; and said separating means discharging said first sheet with its trailing end lower than a leading end of said first sheet, whereby said leading end of said second sheet passes over said trailing end of said first sheet and jamming of said first and second sheets is avoided.

12. A sheet stacking device according to claim 11, wherein:

said means for separating includes a stopper stopping a forward motion of said sheet while said suction belt continues to move;

said stopping of said forward motion causing said porous section to move past said sheet, releasing said suction holding; and said first sheet dropping from said suction belt with its trailing end lower than said leading end of said first sheet, whereby said leading end of said second sheet passes over said trailing end of said first sheet and jamming of said first and second sheets is avoided.

13. A sheet stacking device according to claim 11, wherein:

said means for separating includes a scraper;

said scraper releasing said suction holding of said sheets; and said first sheet dropping from said suction belt with its trailing end lower than said leading end of said first sheet, whereby said leading end of said second sheet passes over said trailing end of said first sheet and jamming of said first and second sheets is avoided.

14. A sheet stacking device according to claim 11, wherein:

said means for separating includes a scraper/stopper;

said scraper/stopper having an arcuate section which peels said leading end of said sheet from said suction belt while stopping a forward motion of said sheet;

said stopping of said forward motion causing said porous section to move past said sheet, releasing said suction holding; and said first sheet dropping from said suction belt with its trailing end lower than said leading end of said first sheet, whereby said leading end of said second sheet passes over said trailing end of said first sheet and jamming of said first and second sheets is avoided.

15. A sheet stacking device for conveying and stacking at least first and second sheets comprising:

a suction box;

a suction belt;

at least a portion of said suction belt passing in contact with said suction box;

said suction belt having a plurality of porous sections separated by nonporous sections, whereby a suction in said suction box is communicated for suction holding of said first and second sheets moving thereon;

a pitch of porous sections exceeding a length of said first and second sheets;

means for separating said first sheet from said suction belt;

said second sheet being conveyed spaced from and following said first sheet on said suction belt;

said suction being applied only to a central portion of said first and second sheets; and said means for separating being further effective for separating said second sheet from said suction belt; and said separating means discharging said first sheet with its trailing end lower than a leading end of said first sheet, whereby said leading end of said second sheet passes over said trailing end of said first sheet and jamming of said first and second sheets is avoided.

16. A sheet stacking device according to claim 15, wherein:

said means for separating include air blowing apertures; and said air blowing apertures providing an air pressure against a top surface of said sheet, releasing said suction holding, and thereby discharging said first sheet with its trailing end lower than a leading end of said first sheet, whereby said leading end of said second sheet passes over said trailing end of said first sheet and jamming of said first and second sheets is avoided.

17. A sheet stacking device according to claim 15, wherein:

said means for separating includes a sheet peeling device;

said sheet peeling device having at least one peeler section and at least one actuator;

said at least one peeler section elastically positioned above said suction belt; and said actuator providing means for a downward movement of said at least one peeler section, applying a force to a top surface of said sheet, releasing said suction holding, and thereby discharging said first sheet with its trailing end lower than a leading end of said first sheet, whereby said leading end of said second sheet passes over said trailing end of said first sheet and jamming of said first and second sheets is avoided.

18. A sheet stacking device according to claim 15, wherein said porous sections extend over an entire span of said suction belt.

19. A sheet conveying and stacking apparatus for conveying and stacking first and second sheets, said first and second sheets passing sequentially along said apparatus, comprising:

a suction conveyor for conveying said first and second sheets below it;

means for separating said first and second sheets from said suction conveyor above a stacking location; and means for forcing a trailing end of said first sheet to a position lower than a leading end of said first and second sheet when said second sheet is separated from said suction conveyor.

20. A sheet conveying and stacking apparatus according to claim 19, wherein said means for forcing includes suction grasping a portion of said first and second sheets remote from a trailing end thereof.

21. A sheet conveying and stacking apparatus according to claim 19, wherein said means for forcing includes an air blast directed above said trailing end, thereby forcing said trailing end downward.

22. A sheet conveying and stacking apparatus according to claim 19, wherein said means for forcing includes a mechanical device forcing downward a trailing end of said first sheet before a leading end of said second sheet arrives at said stacking location.

23. A sheet conveying and stacking apparatus according to claim 22, wherein said mechanical device includes at least one of a cam, a resilient rod, and a piston-urged member.

24. A method for conveying and stacking first and second sheets with a suction conveyor, comprising:

conveying said first and second sheets sequentially along said suction conveyor;

releasing said first and second sheets over a stacking location; and forcing a trailing end of said first sheet to a position lower than a leading end of said first and second sheet when said second sheet is separated from said suction conveyor.

* * * * *